US011526112B2

(12) United States Patent
Noda et al.

(10) Patent No.: US 11,526,112 B2
(45) Date of Patent: Dec. 13, 2022

(54) POST-PROCESS APPARATUS AND CONTROL METHOD

(71) Applicant: Konica Minolta, Inc., Tokyo (JP)

(72) Inventors: Takashi Noda, Okazaki (JP); Yasuomi Mitsui, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/235,995

(22) Filed: Apr. 21, 2021

(65) Prior Publication Data

US 2021/0364972 A1 Nov. 25, 2021

(30) Foreign Application Priority Data

May 19, 2020 (JP) ..... JP2020-087425
May 26, 2020 (JP) ..... JP2020-091563

(51) Int. Cl.
*G03G 15/00* (2006.01)

(52) U.S. Cl.
CPC ..... *G03G 15/6541* (2013.01); *G03G 15/6582* (2013.01)

(58) Field of Classification Search
CPC ..... G03G 2215/0086
See application file for complete search history.

(56) References Cited

U.S. PATENT DOCUMENTS 5,152,511 A 10/1992 Shido et al.
2002/0076232 A1* 6/2002 Taneko ..... G03G 15/5004 399/88
2009/0230605 A1* 9/2009 Taguchi ..... G03G 15/6538 270/58.08
2012/0082497 A1* 4/2012 Nagasaki ..... G03G 15/6544 227/7

FOREIGN PATENT DOCUMENTS

JP 4280403 B2 * 6/2009
JP 2017-081696 5/2017
JP 2017081696 A * 5/2017
JP 2017-227929 12/2017
JP 2019020432 A * 2/2019 ..... B65H 29/12

OTHER PUBLICATIONS

European Patent Application No. 21203900.2; Partial Search Report; dated Mar. 22, 2022; 12 pages.
European Patent Application No. 21174426.3; Extended Search Report; dated Dec. 22, 2021; 9 pages.

* cited by examiner

*Primary Examiner* — Jennifer Bahls
(74) *Attorney, Agent, or Firm* — BakerHostetler

(57) ABSTRACT

A post-process apparatus may include: a first operation portion that accepts a sheet conveyed from an image forming apparatus and performs a first operation based on a job involved with the sheet, a second operation portion that accepts a sheet manually inserted into the post-process apparatus and performs a second operation different from the first operation, and a control unit that determines timing to perform the second operation in accordance with a condition of the first operation performed.

20 Claims, 37 Drawing Sheets

POST-PROCESS APPARATUS AND CONTROL METHOD

CROSS REFERENCE TO RELATED APPLICATIONS

This application claims priority to Japanese Patent Applications Nos. 2020-087425 and 2020-091563 filed on May 19, 2020 and May 26, 2020, respectively, which are incorporated herein by reference in their entireties.

BACKGROUND

Technological Field

The present disclosure relates to a post-process apparatus, an image forming system, and a control method.

Description of the Related Art

A post-process apparatus that performs various post-processes on a sheet sent from an image forming apparatus has conventionally been known. Such a post-process apparatus operates by being fed with electric power from the image forming apparatus.

Japanese Laid-Open Patent Publication No. 2017-081696 discloses a post-process apparatus capable of performing an auto-stapling process and a manual stapling process with a single stapler. When an instruction to perform auto-stapling and an instruction to perform manual stapling coincide with each other in the post-process apparatus, the post-process apparatus can select which is to be prioritized.

Japanese Laid-Open Patent Publication No. 2017-227929 discloses a post-process apparatus that performs a stapling process operation a prescribed time after insertion by a user of sheets from the outside into a sheet insertion portion.

SUMMARY

When the post-process apparatus attempts to simultaneously perform a plurality of operations (processes), electric power equal to or more than a quantity of electric power defined under specifications may be required. For example, when timing to perform a punching process coincides with timing to perform a manual stapling process, the quantity of electric power required for these processes exceeds the quantity of electric power defined under the specifications. Therefore, the process becomes unstable. For example, a position of binding with a staple for manual stapling is disadvantageously displaced.

The present disclosure was made in view of the problems above, and provides a post-process apparatus an operation of which can be prevented from becoming unstable, an image forming system including the post-process apparatus, and a method of controlling a post-process apparatus.

To achieve at least one of the abovementioned objects, according to an aspect of the present disclosure, a post-process apparatus reflecting one aspect of the present disclosure may comprise: a first operation portion that accepts a sheet conveyed from an image forming apparatus and performs a first operation based on a job involved with the sheet, a second operation portion that accepts a sheet manually inserted into the post-process apparatus and performs a second operation different from the first operation, and a control unit that determines timing to perform the second operation in accordance with a condition of the first operation performed.

To achieve at least one of the abovementioned objects, according to yet another aspect of the present disclosure, a post-process apparatus reflecting yet another aspect of the present disclosure comprises a sheet insertion portion, a post-process portion that performs at a prescribed post-process position, a first post-process on a sheet inserted from the outside into the sheet insertion portion, holding means for electrically holding the post-process portion at the prescribed post-process position, and control means for setting holding electric power for electrically holding the holding means to magnitude at which the post-process portion is not displaced from the post-process position in the first post-process by the post-process portion on the sheet inserted from the outside into the sheet insertion portion.

To achieve at least one of the abovementioned objects, according to yet another aspect of the present disclosure, a method of controlling a post-process apparatus reflecting yet another aspect of the present disclosure comprises accepting, by a first operation portion, a sheet conveyed from an image forming apparatus and performing, by the first operation portion, a designated first operation, accepting, by a second operation portion, a sheet manually inserted into the post-process apparatus and performing, by the second operation portion, a second operation different from the first operation, and determining timing to perform the second operation in accordance with a condition of the first operation performed.

BRIEF DESCRIPTION OF THE DRAWINGS

The advantages and features provided by one or more embodiments of the disclosure will become more fully understood from the detailed description given hereinbelow and the appended drawings which are given by way of illustration only, and thus are not intended as a definition of the limits of the present disclosure.

DETAILED DESCRIPTION OF EMBODIMENTS

Figure 1:
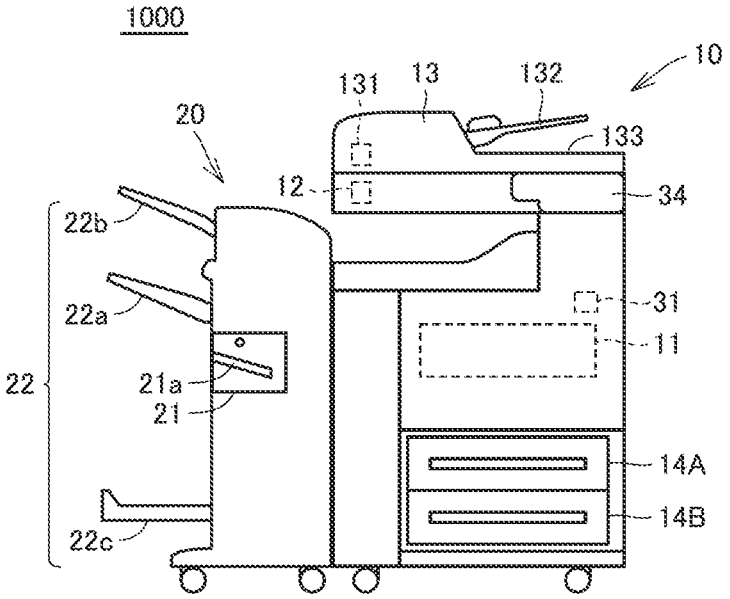
FIG. 1 is a diagram showing an overall construction of an image forming system.

Hereinafter, one or more embodiments of the present disclosure will be described with reference to the drawings. However, the scope of the disclosure is not limited to the disclosed embodiments.

Disclosure I

An image forming system in an embodiment will be described below with reference to the drawings. When the number and an amount are mentioned in embodiments described below, the scope of the present disclosure is not necessarily limited to the number and the amount unless otherwise specified. The same or corresponding elements have the same reference numerals allotted and redundant description may not be repeated.

The drawings are not to scale, and for facilitating understanding of a structure, the drawings may be modified in scale for clarification of the structure. Each modification described below may selectively be combined as appropriate.

A configuration including an image forming apparatus and a post-process apparatus is referred to as an "image forming system" below. In the image forming system, the image forming apparatus may contain the post-process apparatus.

A. Image Forming System

FIG. 1 is a diagram showing an overall construction of an image forming system 1000.

Referring to FIG. 1, image forming system 1000 includes an image forming apparatus 10 and a post-process apparatus 20. In the present embodiment, a multi-function peripheral (MFP) with a plurality of functions such as a scanner function, a copying function, a facsimile function, a network function, and a BOX function is shown as a typical example of image forming apparatus 10.

Image forming apparatus 10 includes a controller 31, a control panel 34, an auto document feeder (ADF) 13, an image scanning apparatus (scanner) 12, paper feed units 14A and 14B, and an image forming unit 11. Auto document feeder 13 includes an image scanning apparatus (scanner) 131, a tray 132 from which a document is supplied into the apparatus, and a tray 133 to which a document is ejected from the apparatus.

Image forming system 1000 (specifically, image forming apparatus 10) is typically communicatively connected to various information processing apparatuses (for example, a server apparatus, a personal computer, and a tablet terminal) over a network. When image forming system 1000 accepts a job from a personal computer and a tablet terminal, it executes the job.

Control panel 34 accepts a user operation. Image forming system 1000 executes a job indicated through control panel 34.

Controller 31 controls overall operations by image forming system 1000. Specifically, each component of image forming system 1000 is operated based on contents set through control panel 34.

Image scanning apparatus 12 is a platen type apparatus that scans a document one by one through platen glass.

Auto document feeder 13 is a sheet-through type apparatus capable of automatically scanning a plurality of documents. In scanning both of surfaces of a document with auto document feeder 13, image scanning apparatus 131 of auto document feeder 13 scans a rear surface of the document and image scanning apparatus 12 scans a front surface of the document. Instead of such a configuration to simultaneously scan both of the surfaces, the configuration may be such that both of surfaces of a document are sequentially scanned with the document being automatically reversed. In the latter configuration of automatic reversal, image scanning apparatus 131 of auto document feeder 13 does not have to be provided.

Sheets are accommodated in paper feed units 14A and 14B. Paper feed units 14A and 14B supply accommodated sheets to image forming unit 11.

Image forming unit 11 forms a toner image in accordance with an image pattern of an object to be printed and prints the toner image on a sheet. A timing roller adjusts conveyance of a sheet in accordance with a position of the toner image conveyed within the image forming unit based on a result of sensing of the sheet by a timing sensor. The toner image formed in the image forming unit is thus printed at an appropriate position of the sheet.

Post-process apparatus 20 includes a stapling process apparatus 21 and a plurality of exit trays 22 (22*a*, 22*b*, and 22*c*). A sheet for which a printing process has been completed is sent from image forming apparatus 10 to post-process apparatus 20. Post-process apparatus 20 performs a process (a post-process) on the sheet for which the printing process has been completed and ejects the sheet to exit tray 22.

Stapling process apparatus 21 (a stapling mechanism or a stapling unit) can perform an auto-stapling process and a manual stapling process. Stapling process apparatus 21 is activated when a user sets the auto-stapling process or when the user inserts a sheet into a sheet insertion port 21*a* and has the manual stapling process performed. In the auto-stapling process, before a bundle of sheets is ejected to exit tray 22, stapling process apparatus 21 staples the ejected bundle of sheets.

B. Manual Stapling

Figure 2A:
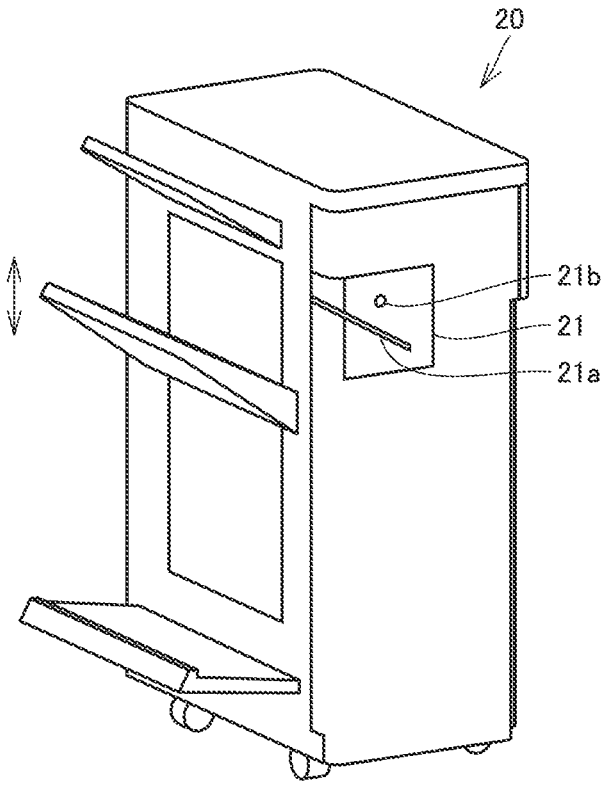
FIG. 2A is an overall perspective view of a post-process apparatus including a stapling process apparatus.
Figure 2B:
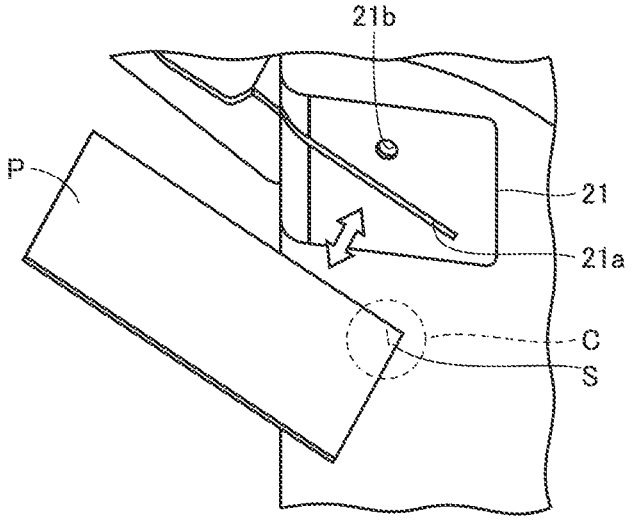
FIG. 2B is a schematic diagram for illustrating a manual stapling process performed by the stapling process apparatus.

FIGS. 2A and 2B are diagrams showing stapling process apparatus 21 provided in post-process apparatus 20. FIG. 2A is an overall perspective view of post-process apparatus 20 including stapling process apparatus 21. FIG. 2B is a schematic diagram for illustrating a manual stapling process performed by stapling process apparatus 21.

Referring to FIGS. 2A and 2B, stapling process apparatus 21 is an apparatus for performing a stapling process for binding a plurality of sheets. Stapling process apparatus 21 includes in a front surface of post-process apparatus 20, sheet insertion port 21*a* in a form of a slit through which a plurality of sheets can be inserted.

Sheet insertion port 21*a* is provided with a sheet sensor 511 (see FIG. 5) for sensing insertion of a sheet. Sheet sensor 511 is typically a transmissive optical sensor. Sheet sensor 511 may be an ultrasonic sensor, a reflective sensor, or a touch sensor. Instead of sheet sensor 511, a button (a hardware button or a software button) may be provided for being pressed by a user. Post-process apparatus 20 should only be able to detect insertion of a sheet into sheet insertion port 21*a*.

In the inside of stapling process apparatus 21, a stapling portion 71 (see FIG. 3) that puts a staple into a sheet and bends the put-in staple for binding a plurality of sheets is provided. Stapling portion 71 performs end stapling (which is also referred to as "side stitching"). Stapling portion 71 is also referred to as an end stapling process portion or a side stitch process portion.

Stapling portion 71 can be used in common in the auto-stapling process and the manual stapling process. In other words, in the auto-stapling process, stapling portion 71 inside stapling process apparatus 21 performs the stapling process at a position where it abuts on a bundle of sheets before ejection to exit tray 22, and in the manual stapling process, it performs the stapling process at a position where it abuts on a bundle of sheets inserted into sheet insertion port 21*a*. The stapling portion stands by at a position where it can perform the manual stapling process immediately after insertion of a sheet, except for a period during which the auto-stapling process is being performed.

Stapling process apparatus 21 further includes above sheet insertion port 21*a*, a light emitter 21*b* implemented by an LED. Light emitter 21*b* notifies a user of whether or not the manual stapling process can be performed, by illuminating in green when stapling process apparatus 21 can perform the manual stapling process and illuminating in red when stapling process apparatus 21 cannot perform the manual stapling process.

As shown in FIG. 2B, a bundle of sheets P is inserted by a user in conformity with a shape of the slit in sheet insertion port 21*a*. An area C refers to a corner of bundle of sheets P on which the stapling process is to be performed. Area C is inserted in a direction of abutment on the stapling portion inside stapling process apparatus 21. As the sheet sensor senses insertion of the sheets into the insertion port, light emitter 21*b* illuminates in red and the stapling portion puts a staple S into area C. When the manual stapling process is completed and the sheet sensor senses removal of the sheet from the insertion port, light emitter 21*b* illuminates in green.

C. Internal Construction of Post-Process Apparatus

Figure 3:
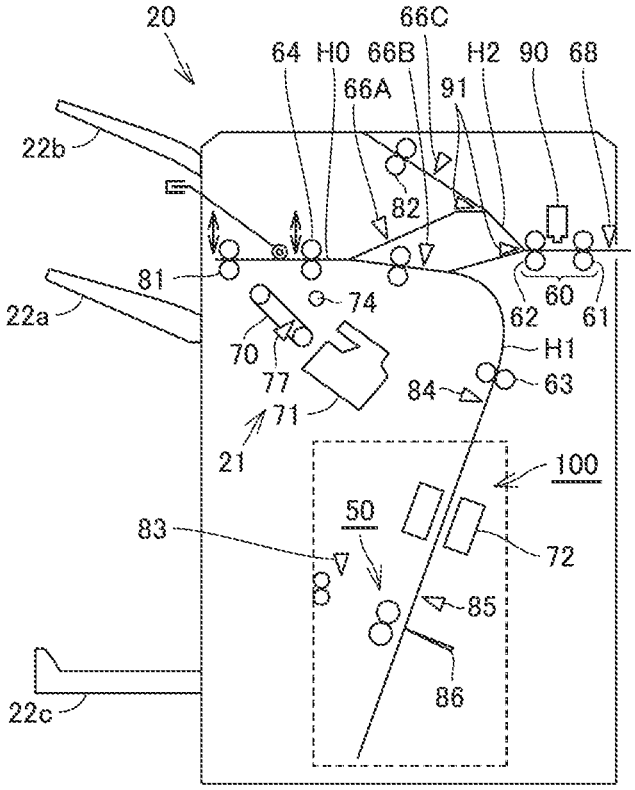
FIG. 3 is a schematic cross-sectional view of the post-process apparatus.

FIG. 3 is a schematic cross-sectional view of post-process apparatus 20.

Referring to FIG. 3, post-process apparatus 20 includes a sheet carry-in portion 60 for conveying a sheet within post-process apparatus 20 and a plurality of post-process portions. Post-process apparatus 20 includes as the post-process portions, a punching (hole punch) process portion 90, a folding portion 50, stapling portion 71 that performs end stapling described above, a saddle stitch process portion 72, and a paper ejection portion that ejects a sheet to a load tray.

A sheet having an image formed thereon that is sent from a paper ejection roller (not shown) of image forming apparatus 10 to post-process apparatus 20 is conveyed into post-process apparatus 20 by a paper stop roller 61 arranged around an inlet of post-process apparatus 20 and an intermediate roller 62 arranged on a left downstream side thereof in sheet carry-in portion 60.

Punching process portion 90 is disposed between paper stop roller 61 and intermediate roller 62 and punches a sheet. Specifically, a pre-registration sensor 68 is provided on a right upstream side of paper stop roller 61 around the inlet of post-process apparatus 20, and when a sheet is introduced to post-process apparatus 20, pre-registration sensor 68 senses carry-in of the sheet. Conveyance of the sheet is stopped a prescribed time period after sensing of carry-in of the sheet and punching process portion 90 punches the sheet (punching process).

Branching into three conveyance paths H0, H1, and H2 is made at a portion downstream from punching process portion 90. Switching among conveyance paths H0, H1, and H2 is made by a conveyance path switching member 91. Conveyance path H1 branched downward leads to a saddle 100 via a saddle carry-in roller 63. Though description will be given later, saddle stitch process portion 72 and folding portion 50 are arranged in saddle 100 and details will be described later.

A saddle carry-in portion sensor 84 that senses carry-in of a sheet into saddle 100 is provided between saddle carry-in roller 63 and saddle 100. A saddle process tray sensor 85 is provided between saddle stitch process portion 72 and a folding knife 86.

Conveyance path H0 leads to exit tray 22*a* provided at an upper left exit of post-process apparatus 20 from a sheet ejection roller 81 via a conveyance roller 64. Exit tray 22*a* is a tray that can be moved up and down (an elevated tray). Exit tray 22*a* is moved downward such that an uppermost surface of an ejected sheet is always at a constant height. Exit tray 22*a* is also referred to as a main tray.

Conveyance path H2 leads from a sheet ejection roller 82 to exit tray 22*b* provided at an upper exit of post-process apparatus 20.

In these conveyance paths, an upper path sensor 66A that senses passage of a sheet through conveyance path H0, a lower path sensor 66B that senses passage of a sheet through conveyance path H1, and a second tray path sensor 66C that senses passage of a sheet through conveyance path H2 are arranged, and timing to drive each conveyance roller is controlled based on sensing by these sensors.

Sheet ejection rollers 81 are movable between a pressure contact state and a distant state. While sheet ejection rollers 81 are in the pressure contact state, a sheet is ejected to exit tray 22*a* as described above. When sheet ejection rollers 81 are in the distant state, a sheet is not immediately ejected to exit tray 22*a*. After the sheet reaches sheet ejection rollers 81, a rear end of the sheet falls onto an accommodation belt 70.

Accommodation belt 70 and a rear end paddle 74 rotate to convey a sheet in a direction toward stapling portion 71. This process is performed a plurality of times for a plurality of sheets. A process tray sheet sensor 77 senses accommodation of a prescribed number of sheets in stapling portion 71 and an end stapling process is performed. Thereafter, accommodation belt 70 and rear end paddle 74 convey a bundle of sheets subjected to end stapling in a direction toward sheet ejection rollers 81 and the bundle of sheets is ejected from between sheet ejection rollers 81 to exit tray 22*c*.

Specifically, process tray sheet sensor 77 senses a sheet accommodated in the process tray where sheets are temporarily accommodated for performing an alignment process and/or an on-line stapling process onto a bundle of sheets (a plurality of sheets).

Saddle 100 is arranged obliquely with respect to a horizontal direction in a portion downstream from saddle carry-in roller 63. Saddle 100 includes a plurality of guide members and a tip end stopper that guide a sheet, saddle stitch process portion 72, folding portion 50, and a sheet width alignment portion, performs a saddle stitch process on at least one sheet, and ejects the sheet to exit tray 22*c*. The sheet ejected to exit tray 22*c* is detected by an ejection sensor 83.

Figure 4:
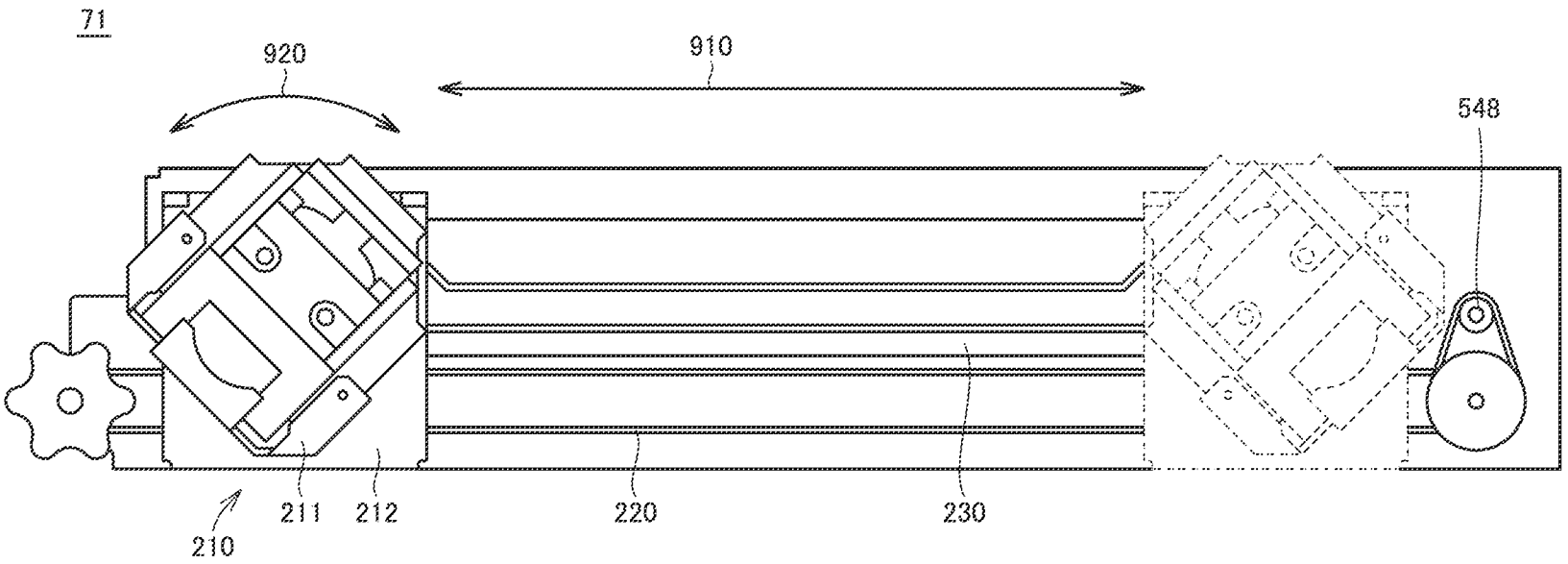
FIG. 4 is a diagram for illustrating a construction of a stapling portion.

FIG. 4 is a diagram for illustrating a construction of stapling portion 71.

Referring to FIG. 4, stapling portion 71 includes a stapler unit 210, a belt 220, a shaft 230, and a stapler unit moving motor 548. Stapler unit 210 includes a main body 211 and a holder 212.

Main body 211 accommodates staples. Main body 211 puts a staple into a sheet and bends the put-in staple. Main body 211 is rotatably supported by holder 212. Main body 211 can rotate in a direction shown with an arrow 920.

Belt 220 rotates as following rotationally driven stapler unit moving motor 548. Holder 21 moves in a direction shown with an arrow 910 as being guided by shaft 230 with rotation of belt 220.

D. Hardware Configuration of Post-Process Apparatus

Figure 5:
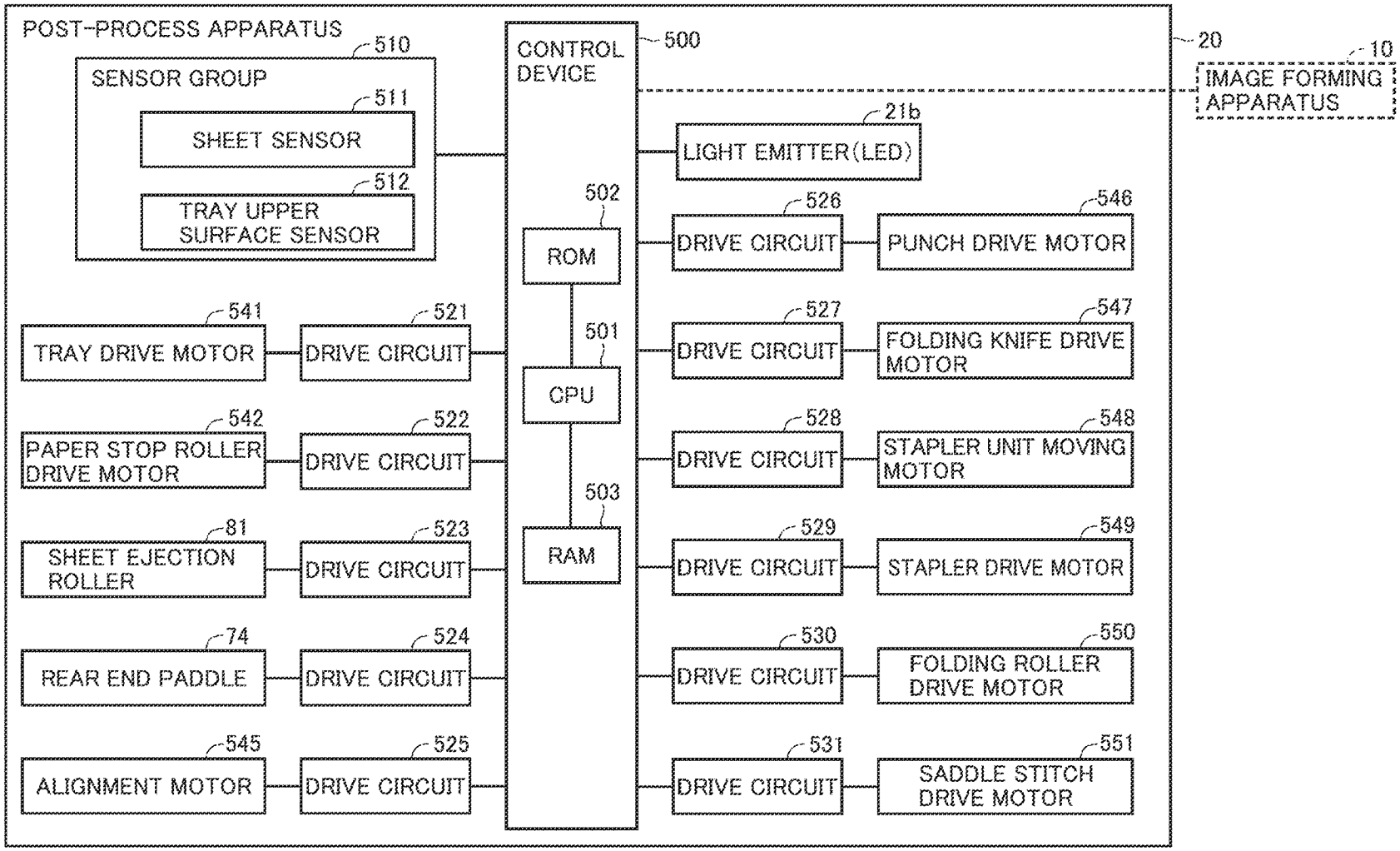
FIG. 5 is a block diagram for illustrating a hardware configuration of the post-process apparatus.

FIG. 5 is a block diagram for illustrating a hardware configuration of post-process apparatus 20.

Referring to FIG. 5, post-process apparatus 20 includes a control device 500, a sensor group 510, drive circuits 521 to 531, a tray drive motor 541, a paper stop roller drive motor 542, sheet ejection roller 81, rear end paddle 74, an alignment motor 545, a punch drive motor 546, a folding knife drive motor 547, stapler unit moving motor 548, a stapler drive motor 549, a folding roller drive motor 550, a saddle stitch drive motor 551, and light emitter 21*b*.

Drive circuits 521, 522, and 525 to 531 drive motors 541, 542, and 545 to 551, respectively. Drive circuit 523 drives sheet ejection roller 81. Drive circuit 524 drives rear end paddle 74.

Sensor group 510 includes sheet sensor 511 provided at sheet insertion port 21*a* (see FIGS. 2A and 2B) for sensing insertion of a sheet. Sensor group 510 further includes a tray upper surface sensor 512. Tray upper surface sensor 512 senses exit tray 22*a* and an uppermost surface while a sheet or a bundle of sheets is loaded on exit tray 22*a*.

Control device 500 includes a central processing unit (CPU) 501 representing an exemplary processor, a read only memory (ROM) 502, and a random access memory (RAM) 503. Control device 500 controls overall operations by post-process apparatus 20. CPU 501 controls input to and output from post-process apparatus 20 by executing firmware (a program). In firmware, a processing routine is set for each load. Firmware is stored in advance in ROM 502.

As tray drive motor 541 is driven, exit tray 22*a* is moved upward and downward. As alignment motor 545 is driven, sheets are aligned. As punch drive motor 546 is driven, the punching process is performed. As folding knife drive motor 547 is driven, a folding process is performed.

As stapler unit moving motor 548 (see FIG. 4) is driven, stapler unit 210 is moved in a direction shown with arrow 910.

As stapler drive motor 549 is driven, a staple is put into a sheet and the staple that has put in is bent. In other words, as stapler drive motor 549 is driven, the stapling process is performed.

E. Functional Configuration of Post-Process Apparatus

Figure 6:
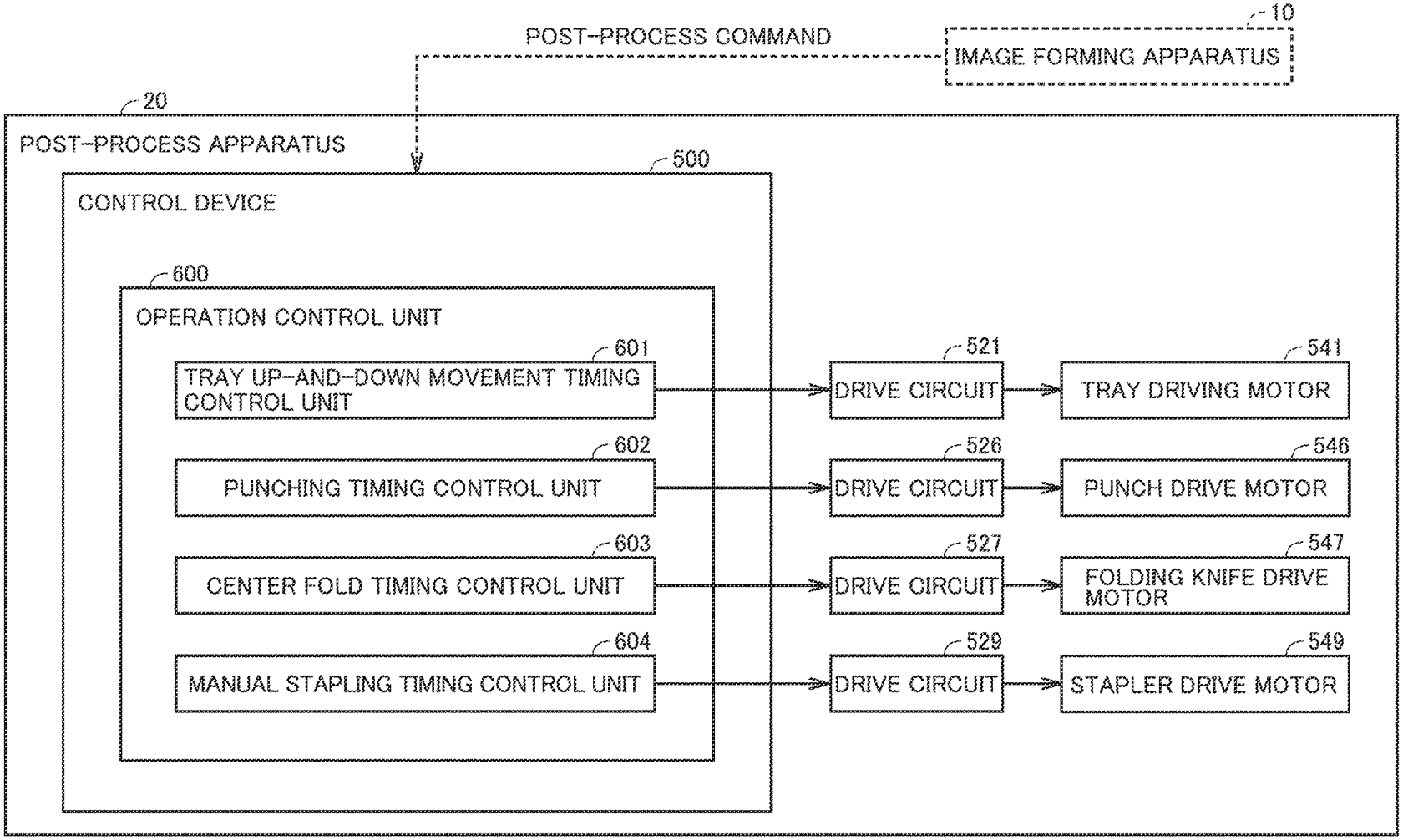
FIG. 6 is a block diagram for illustrating a functional configuration of the post-process apparatus.

FIG. 6 is a block diagram for illustrating a functional configuration of post-process apparatus 20.

Referring to FIG. 6, post-process apparatus 20 includes control device 500, drive circuits 521, 526, 527, and 529, tray drive motor 541, punch drive motor 546, folding knife drive motor 547, and stapler drive motor 549.

Control device 500 includes an operation control unit 600. Operation control unit 600 controls an operation by each member. Operation control unit 600 is implemented by execution of a program such as firmware by CPU 501.

Operation control unit 600 includes a tray up-and-down movement timing control unit 601, a punching timing control unit 602, a center fold timing control unit 603, and a manual stapling timing control unit 604.

Tray up-and-down movement timing control unit 601 controls timing of up-and-down movement of exit tray 22*a* by issuing a command to drive circuit 521. Punching timing control unit 602 controls timing to perform the punching process by issuing a command to drive circuit 526. Center fold timing control unit 603 controls timing to perform the center fold process by issuing a command to drive circuit 527.

Manual stapling timing control unit 604 controls timing to perform the manual stapling process by issuing a command to drive circuit 529. Specifically, manual stapling timing control unit 604 controls timing to put a staple into a sheet.

F. Timing Control

Control of timing will now be described with reference to a plurality of specific examples. An example in which timing to perform one of two processes (operations) is shifted (typically delayed) will be described below. The reason for shifting the timing to perform the process is to avoid coincidence between peaks of currents generated in the two processes. Specifically, timing of a peak of a current value is prevented from coinciding between these processes.

f1. First Example

The manual stapling process during the punching process will be described with reference to FIGS. 7A to 7D.

Signals shown in FIGS. 7A to 7D are extraction of main inputs and outputs associated with the punching process (operation) and the manual stapling process (operation).

A signal (a) from pre-registration sensor 68 that senses a sheet conveyed from image forming apparatus 10 for determining timing of a punching operation and a signal (d) from sheet sensor 511 that senses insertion of a sheet for manual stapling are shown as input signals.

A signal (b) for paper stop roller drive motor 542 that drives paper stop roller 61 that conveys a sheet in punching process portion 90, a signal (c) for punch drive motor 546 that performs a punching operation, and a signal (e) for stapler drive motor 549 that operates the stapler are shown as output signals. "To operate the stapler" means putting a staple into a sheet.

Figure 7A:
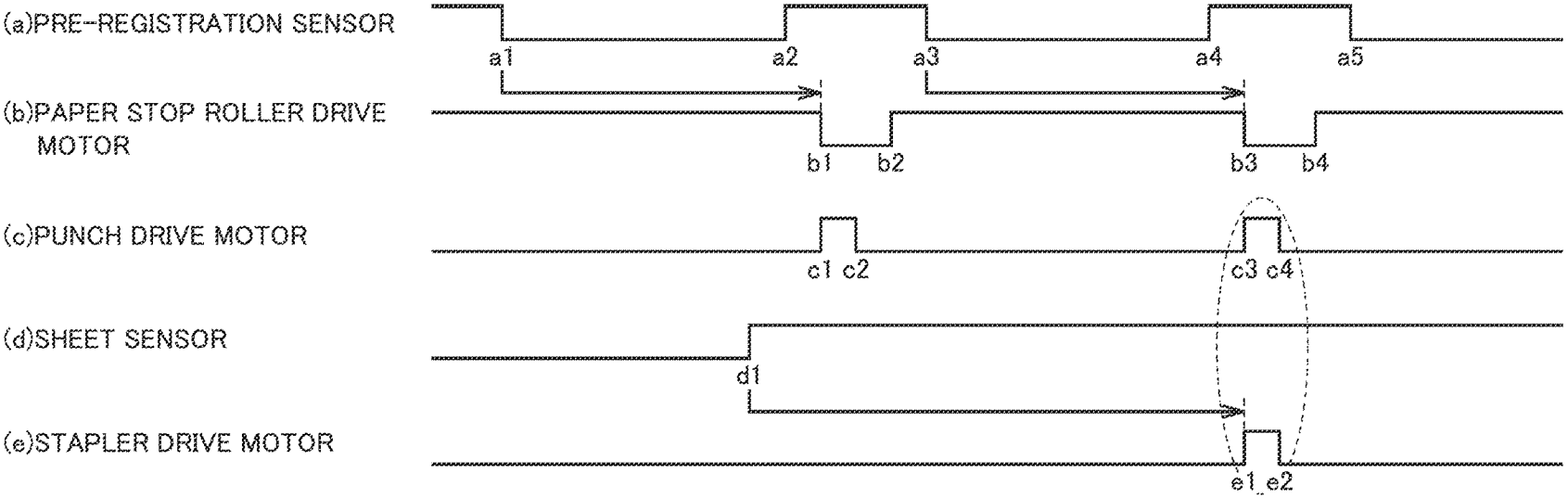
FIG. 7A is a timing chart showing an example in which timing to drive a punch drive motor coincides with timing to drive a stapler drive motor when insertion of a sheet into a sheet insertion port is sensed while a punching job is being executed.

FIG. 7A is a timing chart showing an example in which timing to drive punch drive motor 546 coincides with timing to drive stapler drive motor 549 when insertion of a sheet into sheet insertion port 21*a* (see FIGS. 2A and 2B) is sensed while a punching job is being executed.

When pre-registration sensor 68 senses a sheet conveyed from image forming apparatus 10 (time t=a1), punching process portion 90 performs a punching operation after a prescribed time period (time t=b1) determined in accordance with a length of a conveyed sheet in a direction of paper feed (which is also referred to as an "FD length" below). Punching process portion 90 stops paper stop roller drive motor 542 for temporarily stopping the conveyed sheet (time t=b1) and starts drive of punch drive motor 546 (time t=c1).

As punching process portion 90 completes the punching operation, it stops drive of punch drive motor 546 (time t=c2) and starts drive of paper stop roller drive motor 542. Conveyance of the sheet is thus resumed.

When sheet sensor 511 senses insertion of a sheet for manual stapling (time t=d1), control device 500 has stapler drive motor 549 driven after a prescribed time period (time t=e1) so that manual stapling is performed.

A sheet is conveyed from image forming apparatus 10 at a speed and a sheet interval in accordance with various conditions such as a sheet size or a printing mode. The sheet for manual stapling, however, is inserted by a user who comes in front of post-process apparatus 20 in an attempt at manual stapling. Therefore, the manual stapling process is performed at timing irrelevant to timing of the punching process. Therefore, the punching process (time t=c3) coincides with the manual stapling process (time t=e1). Consequently, a peak value of a consumed current at this time exceeds a specification value defined in advance.

Figure 7B:
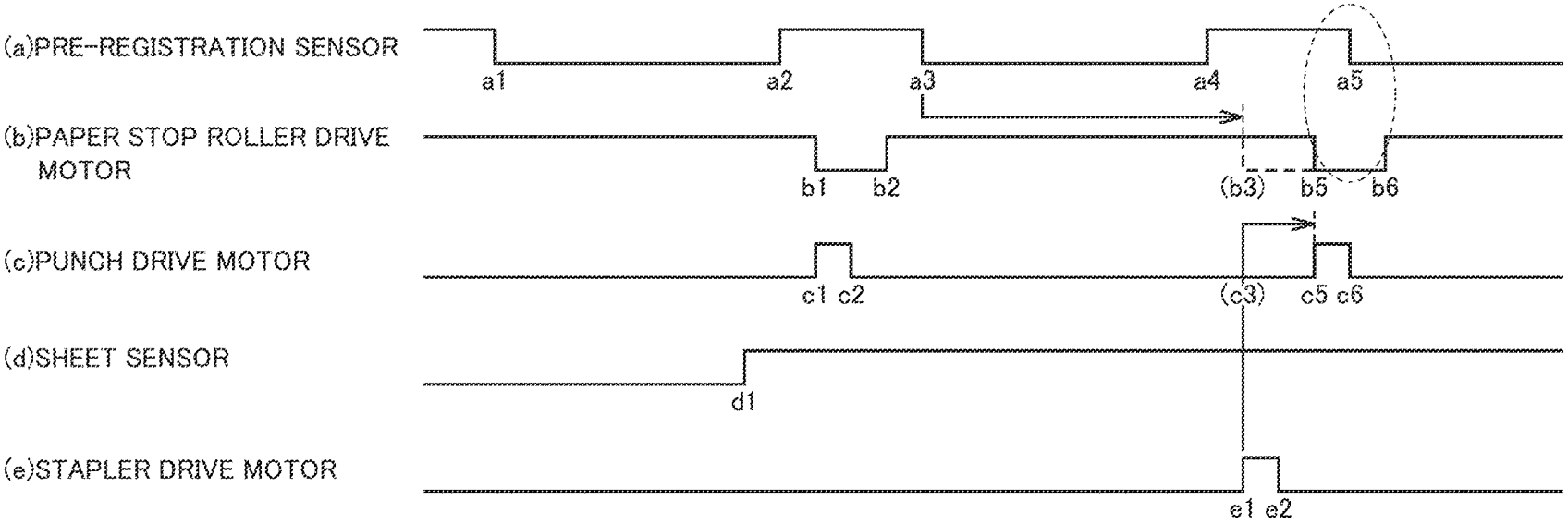
FIG. 7B is a timing chart in delaying timing to perform a punching process in order to avoid coincidence between the punching process and a manual stapling process.

FIG. 7B is a timing chart in delaying timing to perform the punching process in order to avoid coincidence between the punching process and the manual stapling process in the description with reference to FIG. 7A.

Referring to FIG. 7B, if the punching process is performed at usual timing (time t=b3=c3), timing to perform the punching process coincides with timing to perform the manual stapling process. Therefore, control device 500 of post-process apparatus 20 delays timing to perform the punching process such that the punching process is performed after completion of the manual stapling process (time t=b5=c5).

Sheets sent from image forming apparatus 10 are conveyed at prescribed intervals.

Therefore, when timing to perform the punching process is delayed, a next sheet is conveyed while paper stop roller drive motor 542 remains stopped (time t=a5). Consequently, paper jamming may occur. For such a reason, control device 500 delays timing to perform the manual stapling process rather than delaying timing to perform the punching process (see FIG. 7C).

Figure 7C:
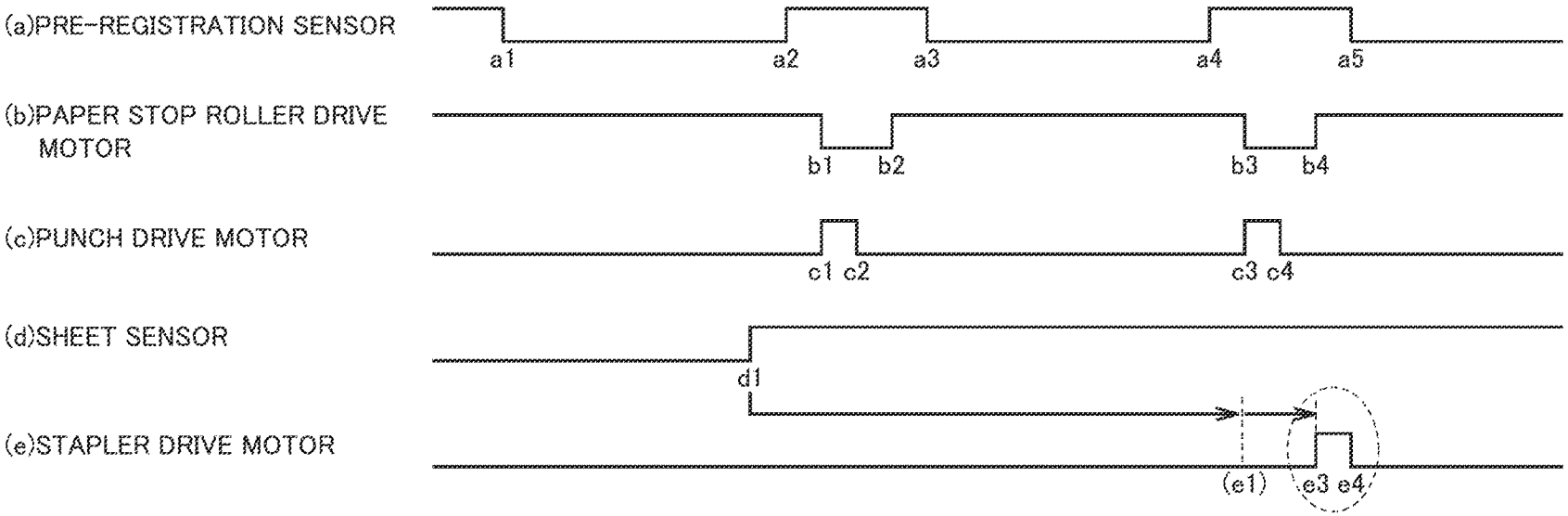
FIG. 7C is a timing chart in delaying timing to perform the manual stapling process in order to avoid coincidence between the punching process and the manual stapling process.

FIG. 7C is a timing chart in delaying timing to perform the manual stapling process in order to avoid coincidence between the punching process and the manual stapling process in the description with reference to FIG. 7A.

Referring to FIG. 7C, if the manual stapling process is performed after lapse of a prescribed time period (time t=e1) since sensing by sheet sensor 511 of insertion of a sheet for manual stapling (time t=d1), the manual stapling process coincides with the punching process. Therefore, control device 500 delays timing to perform the manual stapling process by a time period required for completion of the punching process. In the example in FIG. 7C, control device 500 delays timing to perform the manual stapling process from time t=e1 to time t=e3.

In this example, timing to perform the manual stapling process is delayed to be later than the punching process. When control device 500 determines that manual stapling can be performed before the punching process, however, it may perform the manual stapling process earlier by reducing the prescribed time period described above.

Figure 7D:
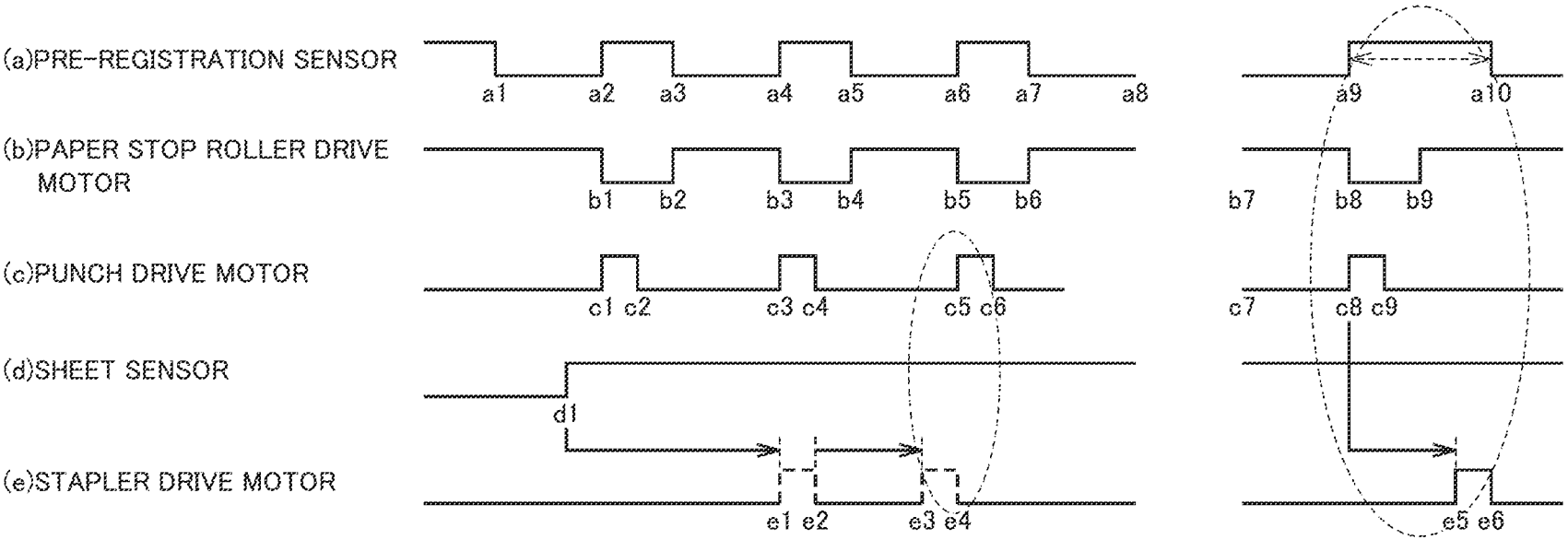
FIG. 7D is a timing chart in delaying timing to perform the manual stapling process in a manner different from that in FIG. 7C, in order to avoid coincidence between the punching process and the manual stapling process.

FIG. 7D is a timing chart in delaying timing to perform the manual stapling process in a manner different from that in FIG. 7C, in order to avoid coincidence between the punching process and the manual stapling process in the description with reference to FIG. 7A.

Referring to FIG. 7D, for example, when a punching job (a job to perform the punching process for each of a plurality of sheets) is executed on sheets short in FD length, a time interval in the punching process (a cycle of the punching process) is shorter than that for a sheet long in FD length. Even when the manual stapling process is thus attempted during execution of a job short in time interval in the punching process, there is no timing that does not coincide with timing of the punching operation. Therefore, the manual stapling process cannot be performed until the punching job ends.

In such a case, control device 500 instructs image forming apparatus 10 to temporarily increase a sheet interval (an interval between sheets of paper) in order to create a time period during which the manual stapling process can be performed. Post-process apparatus 20 performs the manual stapling process (time t=e5) after timing of conveyance of sheets intervals between which are increased in response to the instruction (time t=a9) and after the punching process is performed (time t=b8=c8). An operation to increase a sheet interval in response to an instruction from post-process apparatus 20 may continue for a prescribed period or may be limited to only once. By continuing the operation for the prescribed period, the manual stapling process can continuously be performed.

f2. Second Example

The manual stapling process during the up-and-down operation by exit tray 22*a* will be described with reference to FIGS. 8A to 8C.

Figure 8A:
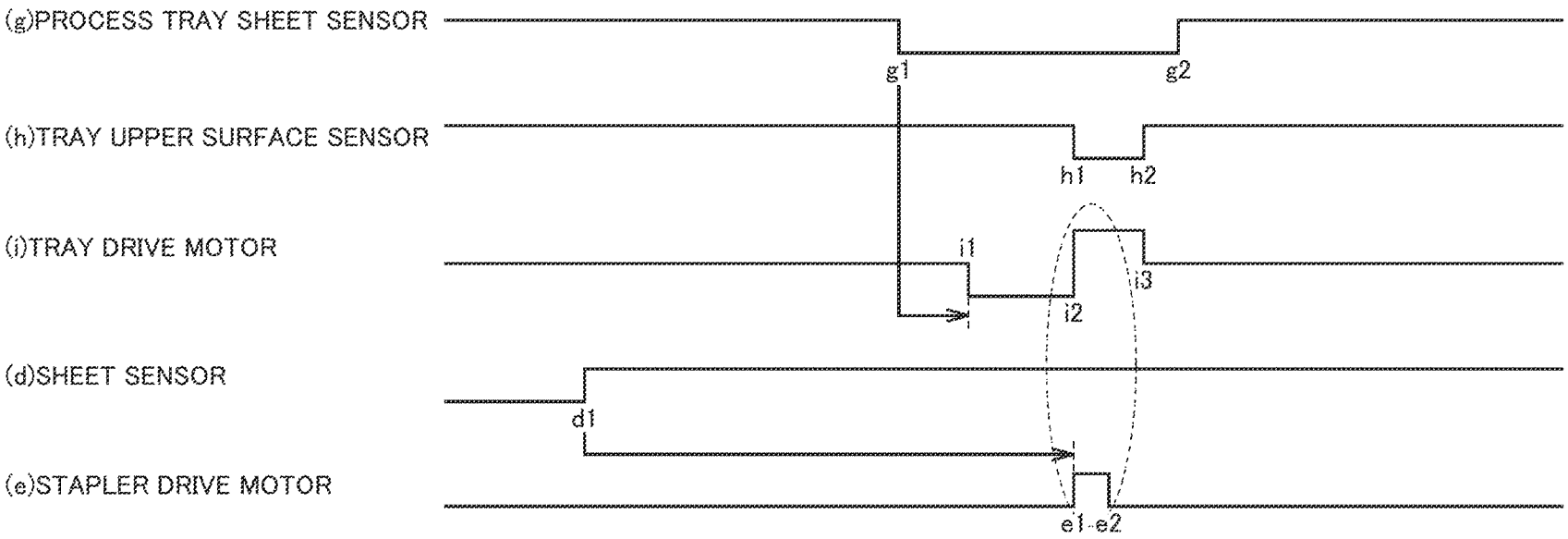
FIG. 8A is a timing chart showing an example in which timing to drive a tray drive motor coincides with timing to drive the stapler drive motor when the manual stapling process is performed based on insertion of a sheet into the sheet insertion port during an up-and-down operation by an exit tray.
Figure 8B:
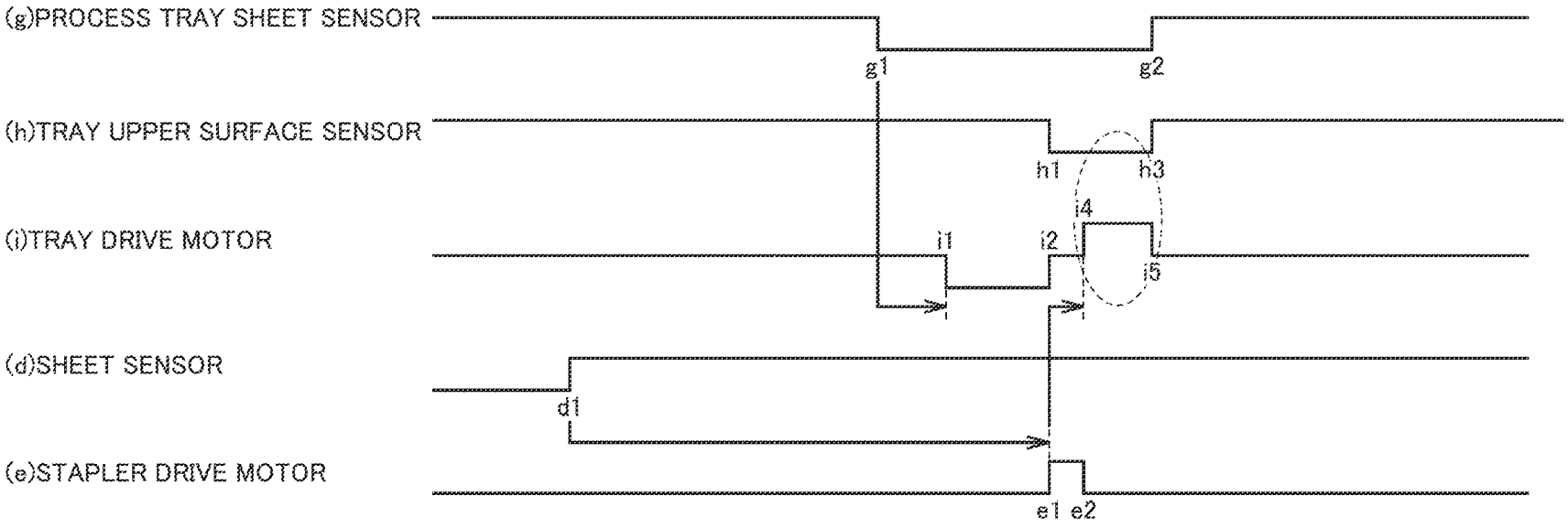
FIG. 8B is a timing chart in delaying timing to move the exit tray upward in order to avoid coincidence between up-and-down operation by the exit tray and the manual stapling process.
Figure 8C:
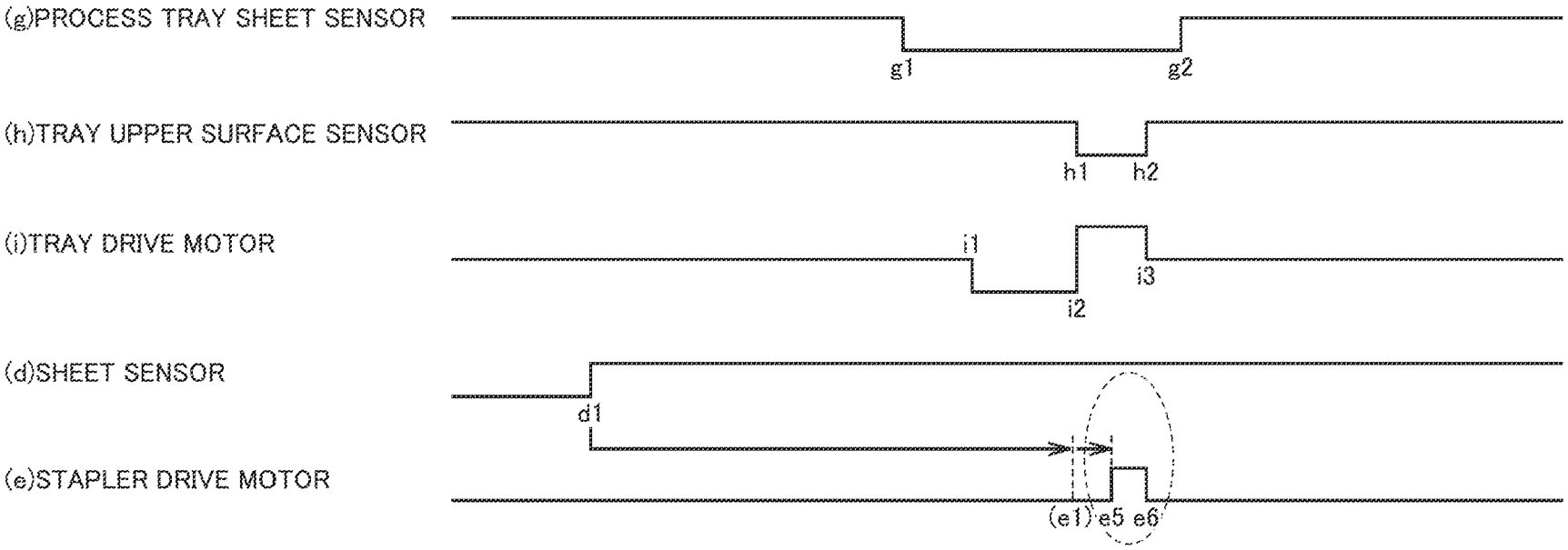
FIG. 8C is a timing chart in delaying timing to perform the manual stapling process in order to avoid coincidence between timing to move the exit tray upward and the manual stapling process.

Signals shown in FIGS. 8A to 8C are extraction of main inputs and outputs associated with an up-and-down movement process (operation) of exit tray 22*a* and the manual stapling process (operation).

A signal (g) from process tray sheet sensor 77 (FIG. 3), a signal (h) from tray upper surface sensor 512 (see FIG. 5), and the (d) signal from sheet sensor 511 are shown as input signals. A signal (i) for tray drive motor 541 for the up-and-down operation by exit tray 22*a* and a signal (e) for stapler drive motor 549 that operates the stapler are shown as output signals.

FIG. 8A is a timing chart showing an example in which timing to drive tray drive motor 541 coincides with timing to drive stapler drive motor 549 when the manual stapling process is performed based on insertion of a sheet into sheet insertion port 21*a* (see FIGS. 2A and 2B) during the up-and-down operation by exit tray 22*a*. In this example, an exemplary up-and-down operation by exit tray 22*a* performed when a bundle of sheets accommodated in the process tray is ejected to exit tray 22*a* after completion of the post-process of the bundle of sheets is shown.

Referring to FIG. 8A, when the post-process onto the bundle of sheets accommodated in the process tray is completed and an operation to eject the bundle of sheets to exit tray 22*a* is performed, process tray sheet sensor 77 is turned off (time t=g1) at prescribed timing after start of the operation to eject the bundle of sheets. A prescribed time period after the timing of turn-off, ejection of the bundle of sheets to exit tray 22*a* is completed. Therefore, control device 500 starts control for driving tray drive motor 541 in a direction of lowering at that timing (time t=i1).

As an operation to lower exit tray 22*a* is continued, tray upper surface sensor 512 that senses an upper surface of the bundle of sheets ejected on exit tray 22*a* is turned off (time t=h1). Therefore, control device 500 stops the lowering operation by exit tray 22*a* (time t=i2).

Then, control device 500 has tray drive motor 541 driven to move exit tray 22*a* upward. Control device 500 has tray drive motor 541 stopped at the time when tray upper surface sensor 512 is turned on again (time t=i3). By stopping exit tray 22*a* at a position where tray upper surface sensor 512 is turned on again, degradation of an aligned state in the direction of paper feed within the process tray due to sagging of the tip end of the sheet accommodated in the process tray can be prevented.

When sheet sensor 511 senses insertion of a sheet for manual stapling (time t=d1), control device 500 has stapler drive motor 549 driven after lapse of a prescribed time period (time t=e1). Manual stapling is thus performed.

A sheet is conveyed from image forming apparatus 10 to post-process apparatus 20 at a speed and a sheet interval (intervals between sheets of paper) in accordance with various conditions such as a sheet size or a printing mode. When a user performs manual stapling, however, the user comes in front of post-process apparatus 20 and inserts a sheet into sheet insertion port 21*a*. Therefore, the manual stapling process is performed at timing irrelevant to timing of the up-and-down operation by exit tray 22A. Therefore, the up-and-down operation by exit tray 22*a* (time t=i1 to i3) coincides with timing to perform the manual stapling process (time t=e1). Consequently, the peak value of the consumed current at this time exceeds a specification value defined in advance.

FIG. 8B is a timing chart in delaying timing to move exit tray 22*a* upward in order to avoid coincidence between the up-and-down operation by exit tray 22*a* and the manual stapling process in the description with reference to FIG. 8A.

Referring to FIG. 8B, sheets are conveyed from image forming apparatus 10 to post-process apparatus 20 at prescribed intervals. Therefore, when timing to start upward movement of exit tray 22*a* is delayed (time t=i4), the tip end of the sheet accommodated in the process tray sags at the upper surface of exit tray 22*a*. Consequently, the aligned state in the direction of paper feed within the process tray may become poor. For such a reason, control device 500 delays timing to perform the manual stapling process rather than delaying timing of upward movement of exit tray 22*a* (see FIG. 8C).

FIG. 8C is a timing chart in delaying timing to perform the manual stapling process in order to avoid coincidence between timing of upward movement of exit tray 22*a* and the manual stapling process in the description with reference to FIG. 8A.

Referring to FIG. 8C, when the manual stapling process is started after lapse of a prescribed time period (time t=e1) since sensing by sheet sensor 51 of insertion of a sheet for manual stapling (time t=d1), the manual stapling process coincides with the upward operation by exit tray 22*a*. Therefore, control device 500 delays timing to perform the manual stapling process by the prescribed time period after start of upward movement of exit tray 22*a* (time t=i2). When tray drive motor 541 is launched or while the tray drive motor is being started up after launch, a large amount of current flows, and when start-up is completed, a consumed current is lowered. The prescribed time period refers to a period during which the manual stapling process is prevented from coinciding only during the start-up period. In the example in FIG. 8C, control device 500 delays timing to perform the manual stapling process to time t=e5.

f3. Third Example

Relation between a saddle stitch and center fold process and the manual stapling process will be described with reference to FIGS. 9A to 9C.

Figure 9A:
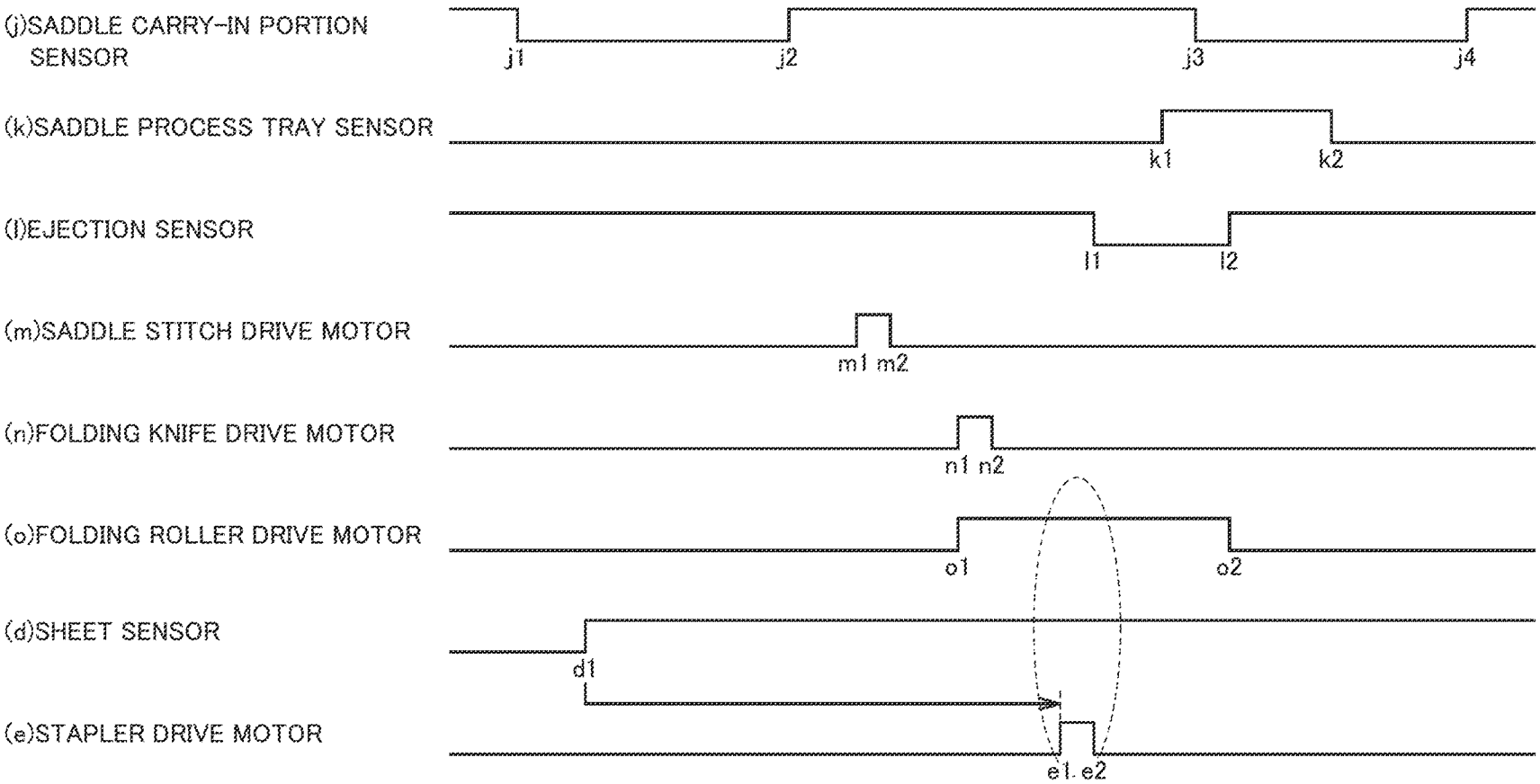
FIG. 9A is a timing chart showing an example in which timing to drive a folding roller drive motor during a center fold operation coincides with timing to drive the stapler drive motor.
Figure 9B:
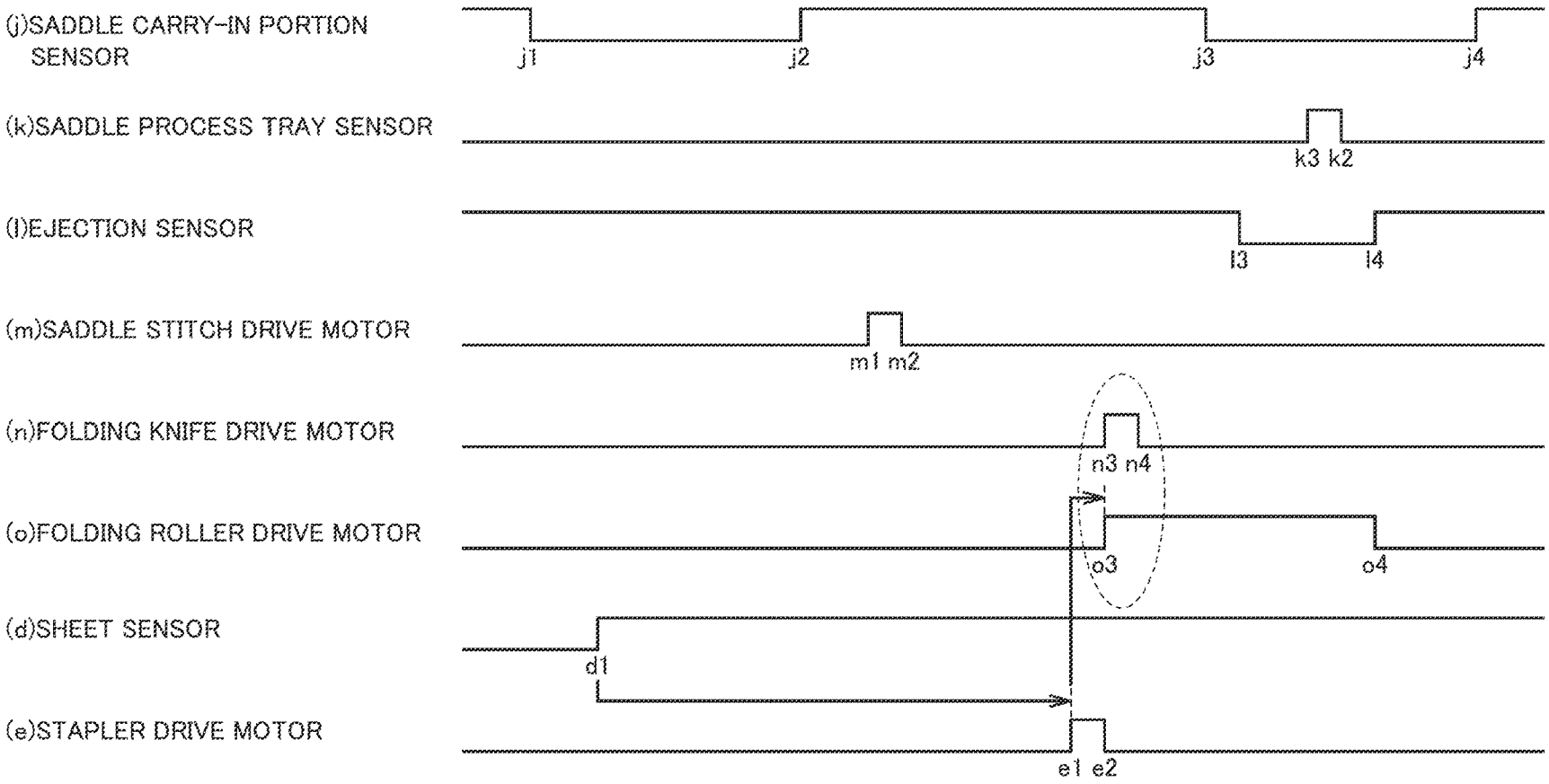
FIG. 9B is a timing chart in delaying timing to perform a center fold process in order to avoid coincidence between the center fold process and the manual stapling process.
Figure 9C:
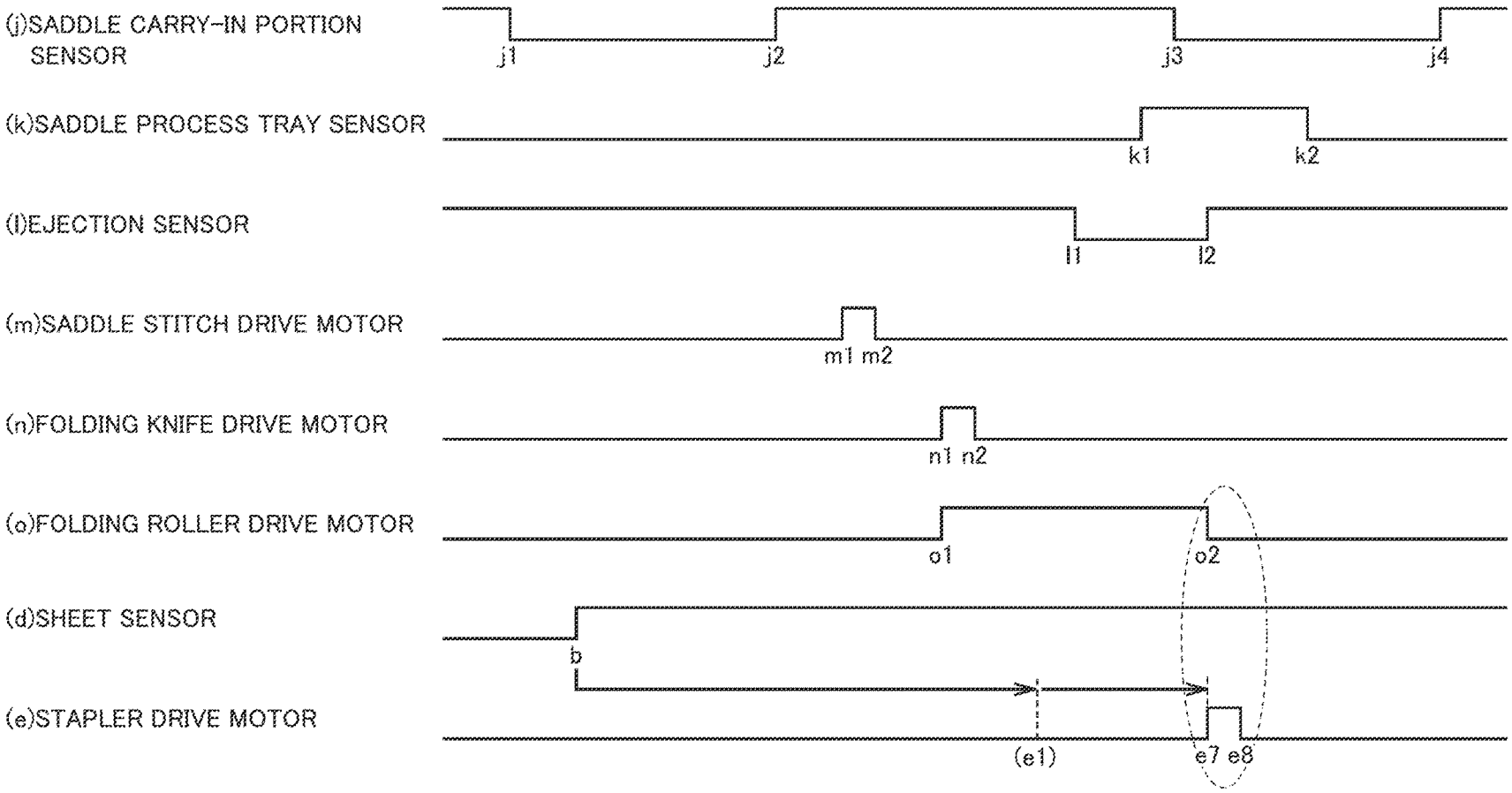
FIG. 9C is a timing chart in delaying timing to perform the manual stapling process in order to avoid coincidence between the center fold process and the manual stapling process.

Signals shown in FIGS. 9A to 9C are extraction of main inputs and outputs associated with the saddle stitch and center fold process (operation) and the manual stapling process (operation).

A signal (j) from saddle carry-in portion sensor 84, a signal (k) from saddle process tray sensor 85, a signal (l) from ejection sensor 83, and the signal (d) from sheet sensor 511 are shown as input signals. A signal (m) for saddle stitch drive motor 551, a signal (n) for folding knife drive motor 547, a signal (o) for folding roller drive motor 550, and the signal (e) for stapler drive motor 549 are shown as output signals.

FIG. 9A is a timing chart showing an example in which timing to drive folding roller drive motor 550 during a center fold operation coincides with timing to drive stapler drive motor 549.

Referring to FIG. 9A, timing to drive folding roller drive motor 550 (time t=o1 to o2) coincides with timing to drive stapler drive motor 549 (time t=e1 to e2). In such a case, a peak value of a consumed current at this time exceeds a specification value defined in advance. Since operations as a whole are similar to those in FIGS. 7A and 8A except that the center fold operation is performed as the post-process, detailed description will not be repeated.

FIG. 9B is a timing chart in delaying timing to perform the center fold process in order to avoid coincidence between the center fold process and the manual stapling process in the description with reference to FIG. 9A.

Referring to FIG. 9B, control device 500 delays timing to perform the center fold process in order to perform the center fold process after the manual stapling process is started. In the example in FIG. 9B, control device 500 delays timing to perform the center fold process to time t=o3. For example, control device 500 delays the timing to perform the center fold process by controlling folding knife drive motor 547 and folding roller drive motor 550 to simultaneously be driven immediately after end of the manual stapling process (time t=e2=n3=o3). Since operations as a whole are similar to those in FIGS. 7B and 8B except that the center fold operation is performed as the post-process, detailed description will not be repeated. Paper jamming or misalignment may occur also when timing to perform the center fold process is delayed.

FIG. 9C is a timing chart in delaying timing to perform the manual stapling process in order to avoid coincidence between the center fold process and the manual stapling process in the description with reference to FIG. 9A.

Referring to FIG. 9C, control device 500 sets time (time t=e7) to start the manual stapling process to time the same as the time to quit driving folding roller drive motor 550 (time t=02). In other words, timing to perform the manual stapling process is delayed from time e1 to e2 to time e7 to e8. By thus delaying timing to perform the manual stapling process, occurrence of defects described above can be suppressed. Since operations as a whole are similar to those in FIGS. 7C and 8C except that the center fold operation is performed as the post-process, detailed description will not be repeated.

f4. Fourth Example

In the first, second, and third examples, when a manual stapling operation coincides with timing (operation timing) of another load imposed in the post-process apparatus, timing to perform the manual stapling process is shifted. An example in which timing to perform the manual stapling process does not necessarily have to be shifted will be described below.

The manual stapling process while exit tray 22*a* is performing the up-and-down operation with image forming apparatus 10 not being operating will be described with reference to FIGS. 10A to 10E. Specifically, an example in which exit tray 22*a* performs the up-and-down operation based on removal by a user of a bundle of sheets loaded on exit tray 22*a* while image forming apparatus 10 is not operating will be described.

Signals shown in FIGS. 10A to 10E are extraction of main inputs and outputs associated with the up-and-down operation by exit tray 22*a* in the above example and the manual stapling process.

The signal (h) from tray upper surface sensor 512 (see FIG. 5) and the signal (d) from sheet sensor 511 are shown as input signals. The signal (i) for tray drive motor 541 for the up-and-down operation by exit tray 22*a* and the signal (e) for stapler drive motor 549 that operates the stapler are shown as output signals.

Figure 10A:
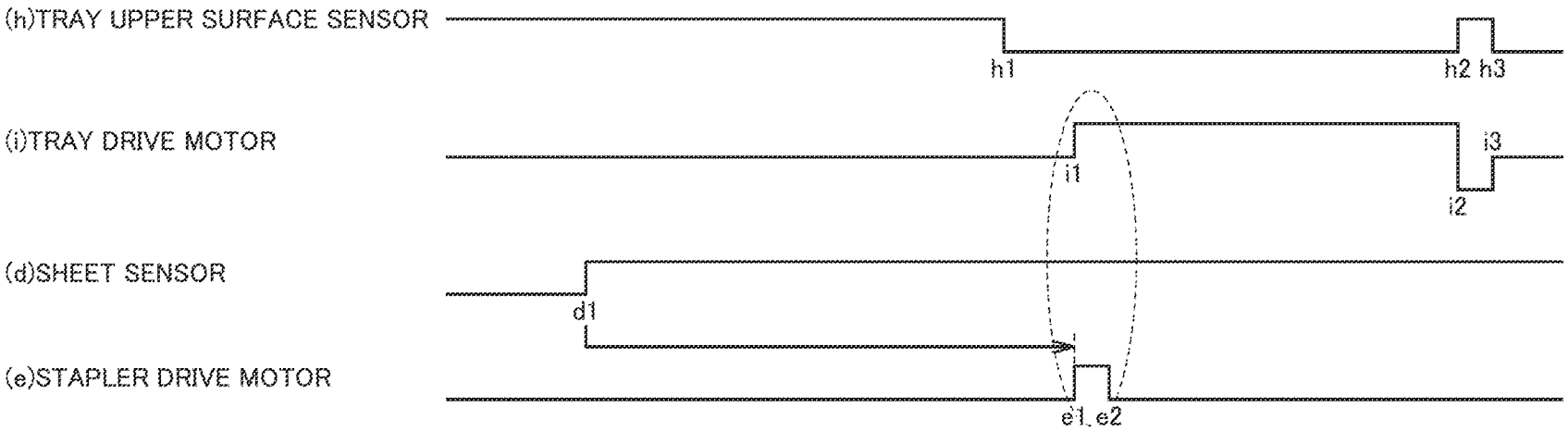
FIG. 10A is a timing chart showing an example in which timing to drive the tray drive motor coincides with timing to drive the stapler drive motor when insertion of a sheet for manual stapling is sensed during an upward operation by the exit tray.

When a sheet (a bundle of sheets) loaded on exit tray 22*a* is removed, control device 500 controls exit tray 22*a* to automatically move upward to a prescribed position. FIG. 10A is a timing chart showing an example in which timing to drive tray drive motor 541 coincides with timing to drive stapler drive motor 549 when insertion of a sheet for manual stapling is sensed during such an up-and-down operation by exit tray 22*a*.

When the bundle of sheets loaded on exit tray 22*a* is removed, tray upper surface sensor 512 is turned off (time t=h1). When tray upper surface sensor 512 is turned off, control device 500 starts to control exit tray 22*a* to move upward to a position where tray upper surface sensor 512 is turned on. Specifically, control device 500 starts to control tray drive motor 541 to be driven in a direction of upward movement of exit tray 22*a* (time t=i1).

When sheet sensor 511 senses insertion of a bundle of sheets for manual stapling (time t=d1), after lapse of a prescribed time period (time t=e1), control device 500 has stapler drive motor 549 driven. Manual stapling is thus performed. A user who comes in front of post-process apparatus 20 removes the bundle of sheets on exit tray 22*a* and inserts sheets for manual stapling. Therefore, timing to drive tray drive motor 541 (time t=i1) coincides with timing to drive the manual stapling process (time t=e1). Consequently, a peak value of a consumed current at this time exceeds a specification value defined in advance.

Figure 10B:
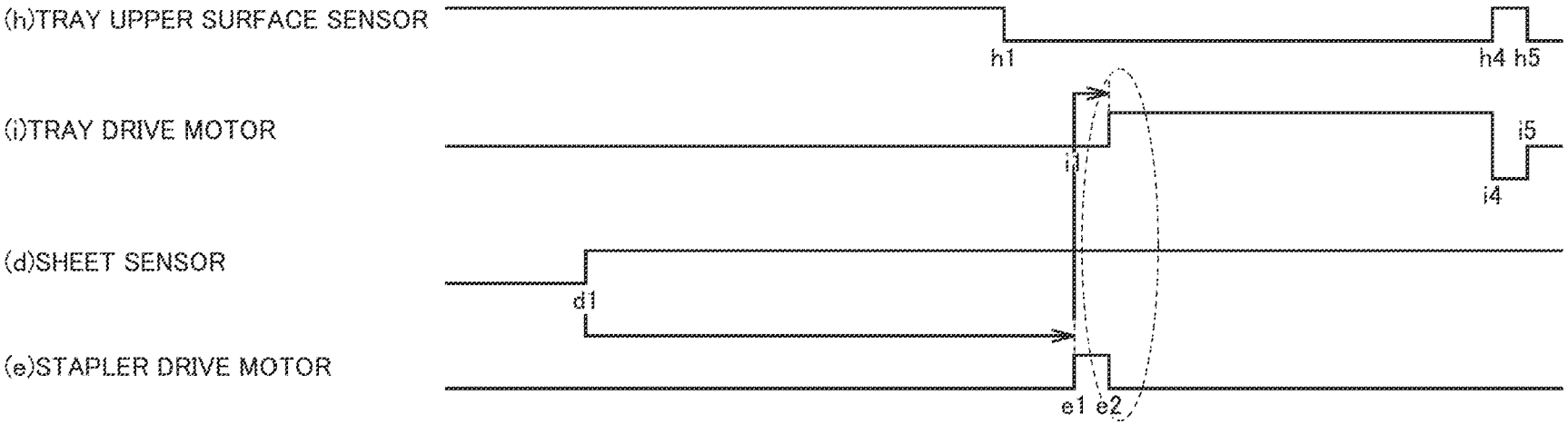
FIG. 10B is a timing chart in delaying timing of the up-and-down operation by the exit tray in order to avoid coincidence between the up-and-down operation by the exit tray and the manual stapling process.

FIG. 10B is a timing chart in delaying timing of the up-and-down operation by exit tray 22*a* in order to avoid coincidence between the up-and-down operation by exit tray 22*a* and the manual stapling process in the description with reference to FIG. 10A.

Figure 10C:
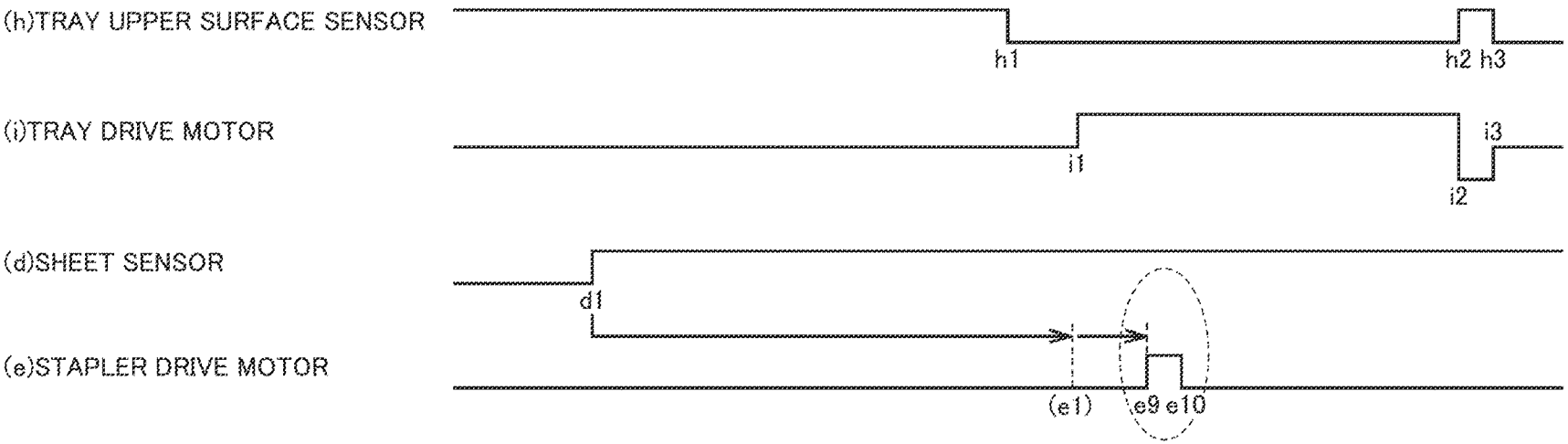
FIG. 10C is a timing chart in delaying timing to perform the manual stapling process in order to avoid coincidence between the up-and-down operation by the exit tray and the manual stapling process.

FIG. 10C is a timing chart in delaying timing to perform the manual stapling process in order to avoid coincidence between the up-and-down operation by exit tray 22*a* and the manual stapling process.

In the up-and-down operation by exit tray 22*a* in the example in FIG. 10A, no sheet is conveyed from image forming apparatus 10. Therefore, by delaying timing to drive tray drive motor 541 as shown in FIG. 10B, the manual stapling process may preferentially be performed. Alternatively, by delaying timing to drive stapler drive motor 549 as shown in FIG. 10C, the up-and-down operation by exit tray 22*a* may preferentially be performed. Any process (operation) may preferentially be performed. For example, a mode for setting whether or not the manual stapling process is to be prioritized may be provided so that control device 500 may determine which drive timing is to be shifted in accordance with the setting of the mode.

Figure 10D:
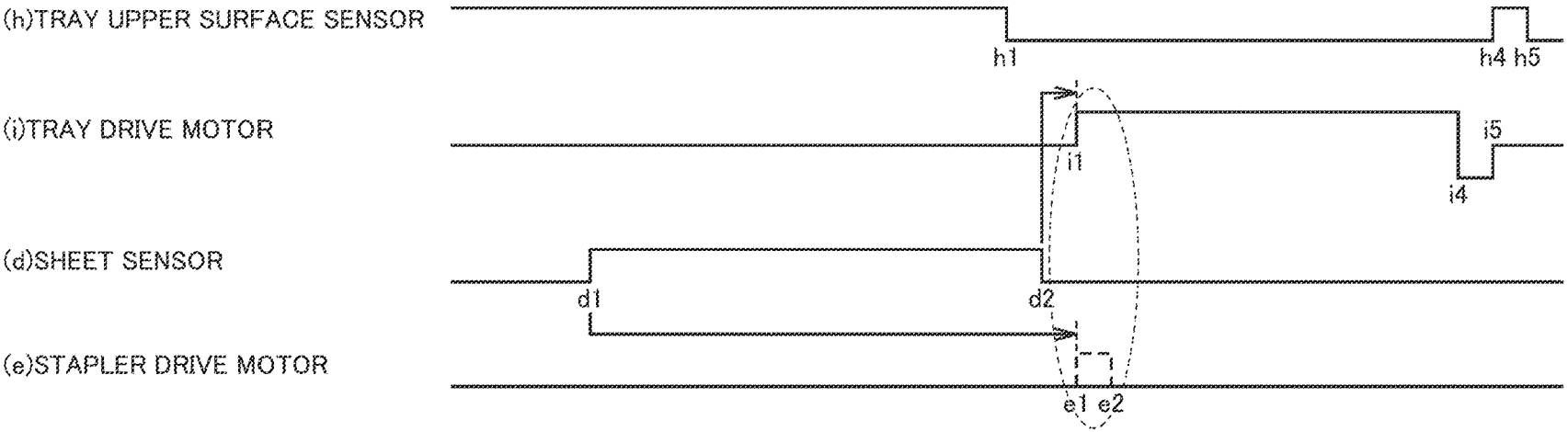
FIG. 10D shows an operation when a bundle of sheets for manual stapling is removed from the sheet insertion port immediately before the manual stapling process in an attempt to perform the manual stapling process.
Figure 10E:
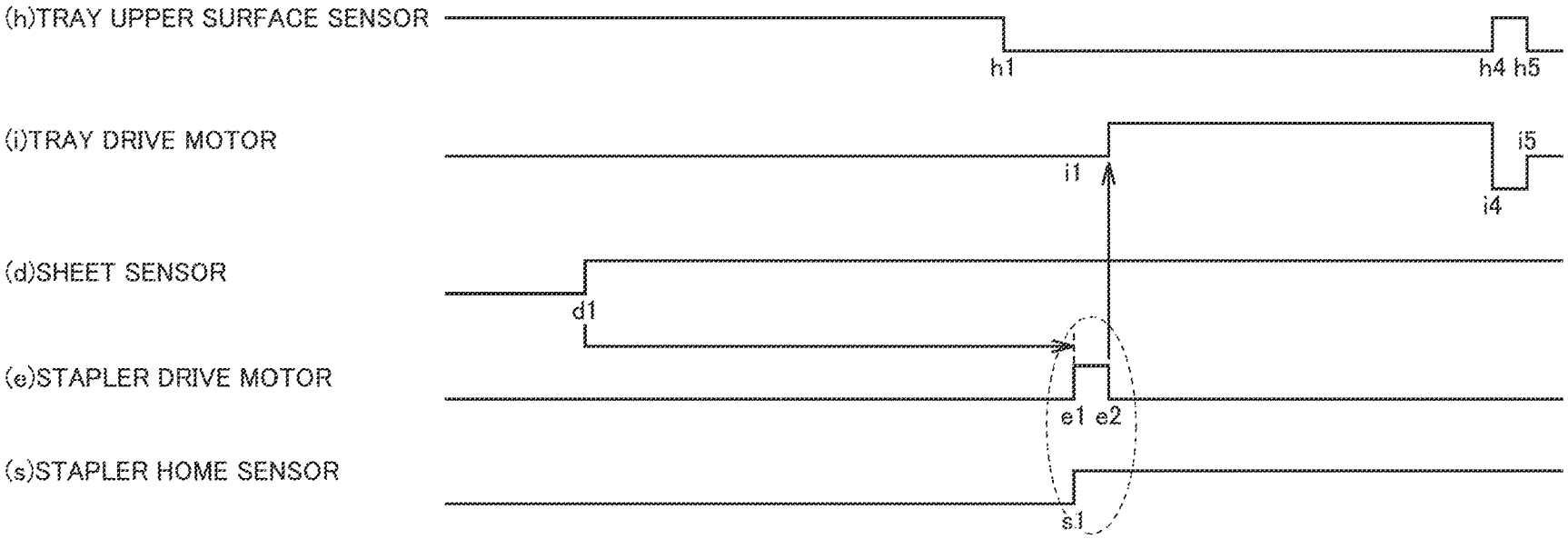
FIG. 10E shows an operation in the event of occurrence of such a phenomenon that staple jamming occurs in the manual stapling process and a stapling portion inside a stapling process apparatus 21 does not return to a home position.

FIGS. 10D and 10E are timing charts showing exemplary operations at the time when an error associated with the manual stapling process occurs in an example where the manual stapling process is prioritized over the up-and-down operation by exit tray 22A.

FIG. 10D shows an operation when the bundle of sheets for manual stapling is removed from sheet insertion port 21*a* immediately before the manual stapling process in an attempt to perform the manual stapling process. As shown in FIG. 10D, when removal of the bundle of sheets for manual stapling is sensed (time t=d2), the manual stapling process is not performed (time t=e1 to e2) and hence control device 500 starts to have tray drive motor 541 driven.

FIG. 10E shows an operation in the event of occurrence of such a phenomenon that staple jamming occurs in the manual stapling process and stapling portion 71 inside stapling process apparatus 21 does not return to a home position. The home position does not refer to a position (a position in a direction shown with arrow 910) of stapling portion 71 described with reference to FIG. 4 but a position of an actuator (a member that puts in a staple) within the stapling portion when stapling portion 71 is in a state (open state) before the bundle of sheets is sandwiched at the position in FIG. 4 (a solid line). The home position refers to a position of the actuator within the stapling portion while stapling portion 71 is not performing an operation to put in a staple.

As shown in FIG. 10E, as drive of stapler drive motor 549 is started, a stapler home sensor is turned off (s1). When the stapler home sensor is not turned on in spite of continued drive of stapler drive motor 549 for a prescribed time period, control device 500 determines that staple jamming has occurred. Consequently, control device 500 starts to have tray drive motor 541 driven in order to start the up-and-down operation by exit tray 22*a* that has been delayed.

f5. Fifth Example

Figure 11:
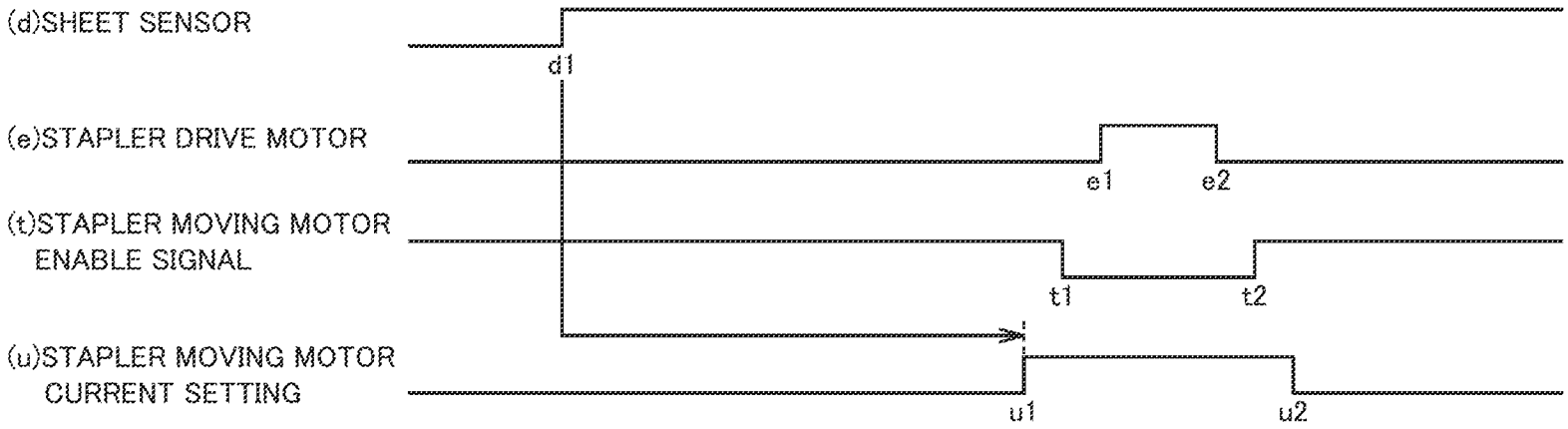
FIG. 11 is a timing chart showing operation timing in performing the manual stapling process while sheet conveyance by an image forming apparatus is not being carried out.

FIG. 11 is a timing chart showing operation timing in performing the manual stapling process while sheet conveyance by image forming apparatus 10 is not being carried out.

The signal (d) from sheet sensor 511 is shown as an input signal. The signal (e) for stapler drive motor 549, a stapler moving motor enable signal (t) for power feed to stapler unit moving motor 548 shown in FIG. 4, and a stapler moving motor current signal (u) for setting magnitude of a current to be fed to stapler unit moving motor 548 are shown as output signals. Stapler unit moving motor 548 moves stapler unit 210 (see FIG. 4) in the direction shown with arrow 910.

When post-process apparatus 20 continuously performs the manual stapling process, stapler unit 210 (FIG. 4) may be displaced from a position where manual stapling is to be performed (the position of stapler unit 210 shown with a solid line in FIG. 4) due to vibration caused while the manual stapling process is performed.

In order to prevent this phenomenon, control device 500 raises holding electric power for stapler unit moving motor 548 that moves stapler unit 210. Control device 500 can thus suppress occurrence of position displacement of stapler unit 210 also against vibration caused while the manual stapling process is performed.

Specifically, control device 500 sets a signal for setting magnitude of a current to be fed to stapler unit moving motor 548 in a direction toward increase (time t=u1). Thereafter, control device 500 turns on the stapler moving motor enable signal (time t=t1). Holding torque of stapler unit moving motor 548 thus increases. When stapler unit moving motor 548 is driven in this state (time t=e1 to e2), position displacement of stapler unit 210 can be suppressed even when vibration is generated as the manual stapling process is performed.

f6. Summary

Specific examples of timing control are described above. The process in post-process apparatus 20 is summarized below with the specific examples being regarded as more generic concepts.

(1) First Operation

Post-process apparatus 20 includes an operation portion (which is also referred to as a "first operation portion" below) that accepts a sheet conveyed from image forming apparatus 10 and performs an operation (which is also referred to as a "first operation" below) based on a job involved with the sheet. The first operation portion accepts the sheet conveyed from image forming apparatus 10 and performs the first operation designated by image forming apparatus 10.

In one aspect, the first operation portion performs the first operation on condition that a sheet conveyed from image forming apparatus 10 is sensed. In one aspect, the first operation portion performs the first operation onto each of a plurality of sheets based on the job.

The first operation is, for example, a post-process on the sheet conveyed from image forming apparatus 10. The post-process is, for example, a punching operation to punch the sheet conveyed from image forming apparatus 10, an auto-stapling operation to automatically staple the sheet conveyed from image forming apparatus 10, or a center fold operation to fold the sheet conveyed from image forming apparatus 10. Alternatively, the first operation is an operation to move exit tray 22*a* upward and downward.

(2) Second Operation

Post-process apparatus 20 includes an operation portion (which is also referred to as a "second operation portion" below) that accepts a sheet manually inserted into post-process apparatus 20 and performs an operation (which is also referred to as a "second operation" below) different from the first operation. The second operation portion performs the second operation on condition that the sheet is manually inserted into post-process apparatus 20. The second operation is, for example, an operation onto a manually inserted sheet. The second operation is, for example, the manual stapling process.

The second operation portion is movable through a prescribed path based on a command from control device 500, and when it performs the second operation, it can temporarily be held at a prescribed position on the prescribed path.

(3) Timing Control by Control Device 500

Post-process apparatus 20 includes control device 500 that determines timing to perform the second operation in accordance with a condition of the first operation performed. In one aspect, control device 500 prioritizes the first operation over the second operation by changing timing to perform the second operation (see FIGS. 7C, 7D, 8C, 9C, and 10C). Alternatively, in one aspect, control device 500 prioritizes the second operation over the first operation by changing timing to perform the first operation (see FIG. 10B).

When control device 500 determines that timing to perform the first operation at least partially coincides with timing to perform the second operation (see FIGS. 7A, 8A, and 9A), it changes timing to perform the second operation (see FIGS. 7C, 7D, 8C, and 9C) based on a condition of conveyance of a sheet conveyed from image forming apparatus 10 to post-process apparatus 20 in succession to a sheet on which the first operation is to be performed.

In changing timing to perform the second operation, when control device 500 determines that the second operation cannot be performed before completion of the first operation onto a plurality of sheets, it controls the second operation portion to perform the second operation before completion of the first operation onto the plurality of sheets by increasing a distance between sheets (see FIG. 7D).

When the second operation is performed while image forming apparatus 10 and post-process apparatus 20 are not operating, control device 500 controls holding power to hold the second operation portion at the prescribed position to be stronger than while image forming apparatus 10 and post-process apparatus 20 are operating (see FIG. 11).

In an example where the first operation is different from the post-process on the sheet (see FIG. 10A), when control device 500 determines that timing to perform the first operation at least partially coincides with timing to perform the second operation, it changes timing to perform the first operation (see FIG. 10B).

When the timing to perform the first operation is changed and when an error associated with the second operation occurs to result in failure in completion of the second operation, control device 500 controls the first operation portion to perform the first operation without waiting for completion of the second operation (see FIGS. 10D and 10E).

When control device 500 determines that a total value of electric power for driving the first operation portion and electric power for driving the second operation portion exceeds a predetermined value, it determines operation timing of the first operation portion or operation timing of the second operation portion such that the total value is equal to or smaller than the predetermined value.

G. Control Structure

Figure 12:
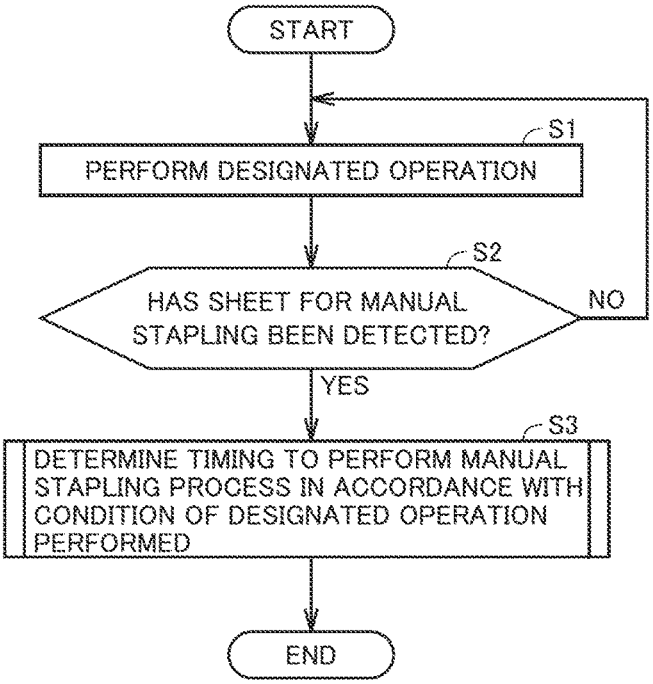
FIG. 12 is a flowchart for illustrating a flow of processing performed in the post-process apparatus.

FIG. 12 is a flowchart for illustrating a flow of processing performed in post-process apparatus 20 in one aspect.

Referring to FIG. 12, in step S1, post-process apparatus 20 performs an operation designated by image forming apparatus 10. In step S2, control device 500 determines whether or not sheet sensor 511 has detected a sheet for manual stapling.

When the sheet has been detected (YES in step S2), in step S3, control device 500 determines timing to perform manual stapling in accordance with a condition of the designated operation performed. When the sheet has not been detected (NO in step S2), the process proceeds to step S1.

Figure 13:
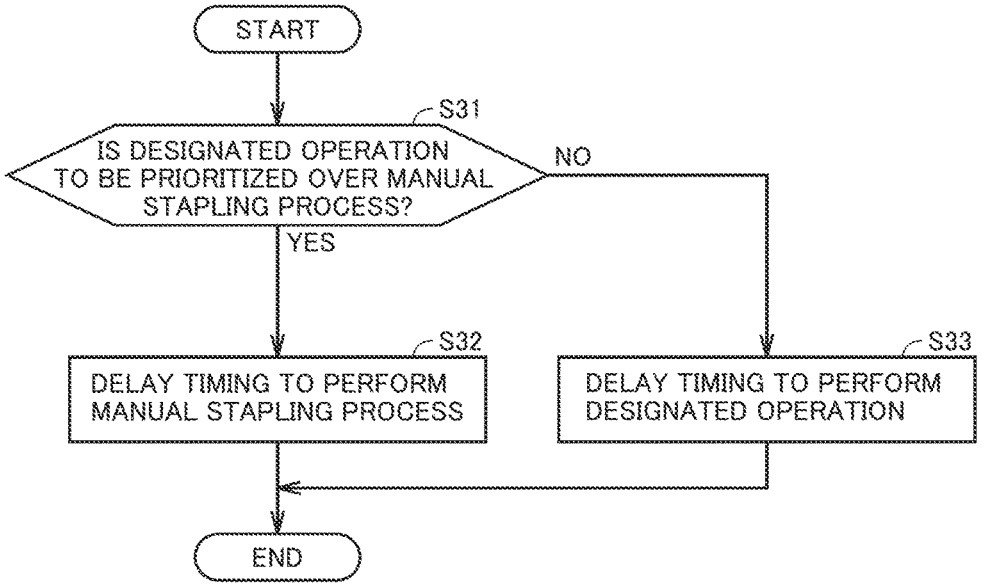
FIG. 13 is a flowchart for illustrating details of processing in step S3 in FIG. 12.

FIG. 13 is a flowchart for illustrating details of processing in step S3 in FIG. 12.

Referring to FIG. 13, in step S31, control device 500 determines whether or not the designated operation is to be prioritized over manual stapling based on predetermined setting. When the designated operation is to be prioritized (YES in step S31), in step S32, control device 500 delays timing to perform the manual stapling process. When the manual stapling process is to be prioritized (NO in step S31), in step S33, control device 500 delays timing to perform the designated operation.

H. Advantages

As described above, when post-process apparatus 20 attempts to simultaneously perform a plurality of operations (processes), electric power equal to or more than a quantity of electric power determined under specifications may be required. By controlling timing as described above, however, the quantity of electric power determined under the specifications in post-process apparatus 20 can be prevented from being exceeded. Therefore, the process performed in post-process apparatus 20 is stabilized. Unstable operations in post-process apparatus 20 can be prevented. For example, such a defect as displacement of a position of binding with a staple in manual stapling can be prevented.

Advantages above will specifically be described below based on measurement results.

Post-process apparatus 20 operates by receiving supply of a prescribed voltage (for example, 24 V) from image forming apparatus 10. Therefore, an upper limit value of a consumed current used in post-process apparatus 20 has been set. An effective value (RMS) of a peak current of the consumed current, for example, in a 10-ms section has been set to 12 amperes (A) or lower.

Figure 14:
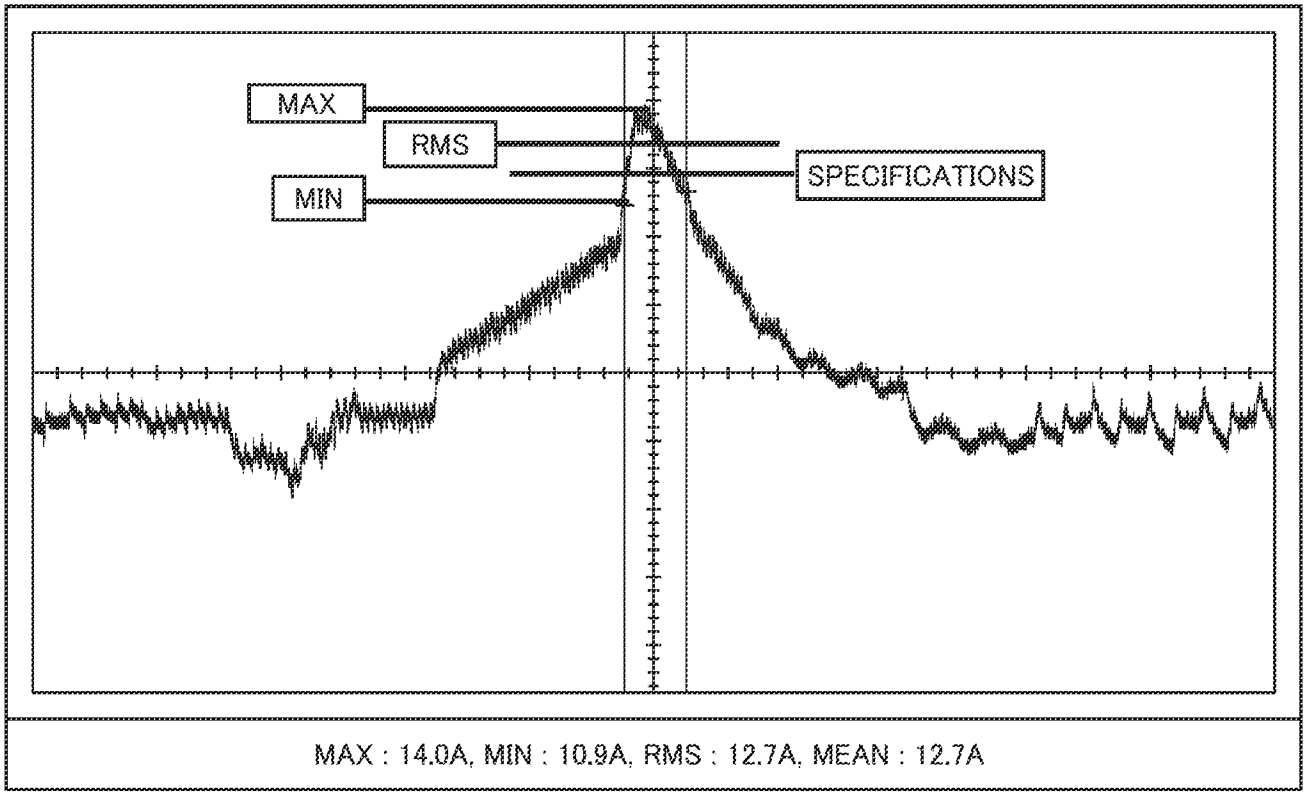
FIG. 14 is a diagram showing a measurement waveform when timing to perform the punching process and timing to perform the manual stapling process coincide with each other as shown in FIG. 7A.

FIG. 14 is a diagram showing a measurement waveform (current waveform) when timing to perform the punching process and timing to perform the manual stapling process coincide with each other as shown in FIG. 7A. Referring to FIG. 14, in a measurement waveform, a maximum value (MAX) of a current in the 10-ms section is 14.0 A, a minimum value (min) of the current in that section is 10.9 A, and the effective value (RMS) of the current in that section is 12.7 A. Both of the maximum value and the effective value thus exceed 12 A which is the current value (upper limit value) determined under the specifications.

Figure 15:
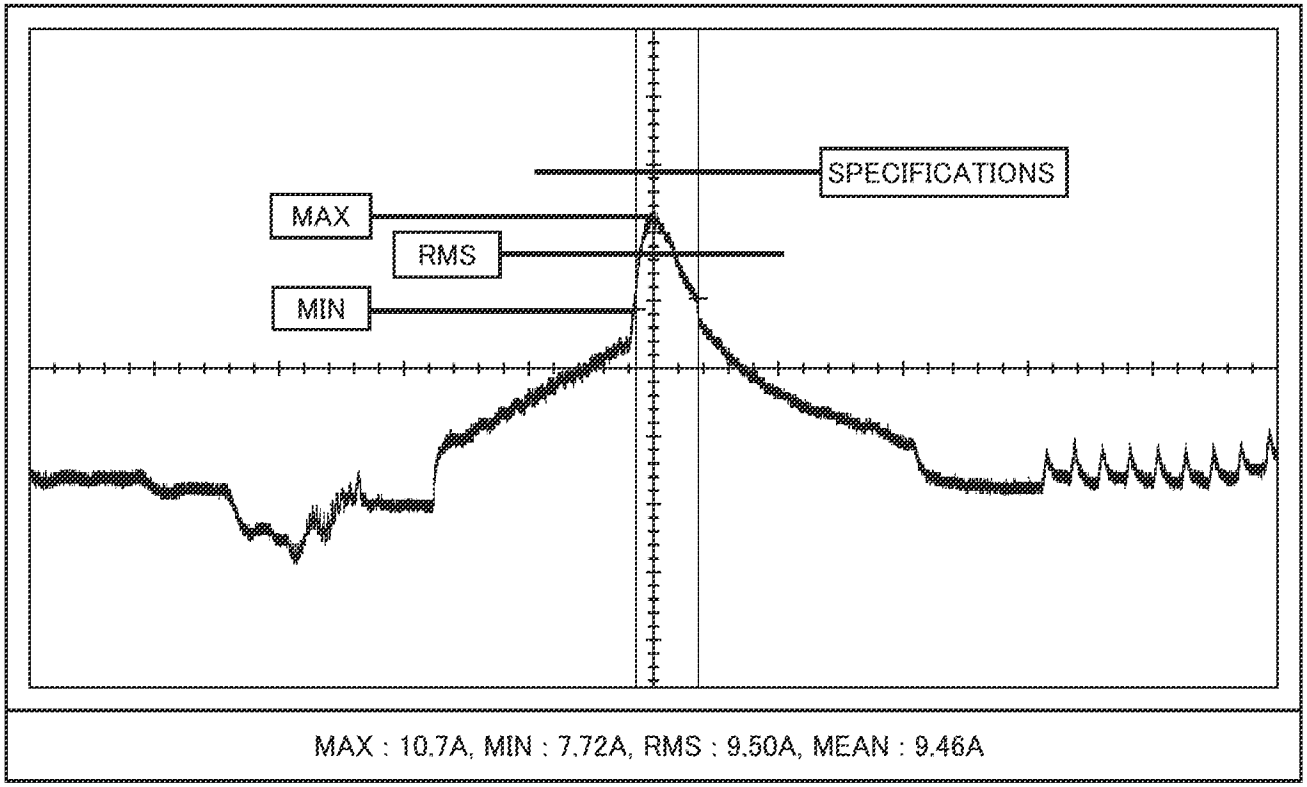
FIG. 15 is a diagram showing a measurement waveform when the manual stapling process is delayed as shown in FIG. 7C.

FIG. 15 is a diagram showing a measurement waveform (current waveform) when the manual stapling process is delayed as shown in FIG. 7C.

Referring to FIG. 15, the maximum value (MAX) of the current in the 10-ms section is 10.7 A, the minimum value (min) of the current in that section is 7.72 A, and the effective value (RMS) of the current in that section is 9.50 A. By delaying the manual stapling process, not only the effective value but also the maximum value can thus be prevented from exceeding 12 A which is the current value (upper limit value) determined under the specifications. Therefore, the manual stapling process can be stabilized.

A program that controls timing described above can be distributed as being stored in a non-transitory recording medium.

I. Additional Aspects

A post-process apparatus includes a first operation portion that accepts a sheet conveyed from an image forming apparatus and performs a first operation based on a job involved with the sheet, a second operation portion that accepts a sheet manually inserted into the post-process apparatus and performs a second operation different from the first operation, and a control unit that determines timing to perform the second operation in accordance with a condition of the first operation performed.

Preferably, the control unit prioritizes the first operation over the second operation by changing the timing to perform the second operation.

Preferably, the first operation portion performs the first operation on condition that the sheet conveyed from the image forming apparatus is sensed. The second operation portion performs the second operation on condition that the sheet is manually inserted into the post-process apparatus. When the control unit determines that the timing to perform the first operation at least partially coincides with the timing to perform the second operation, the control unit changes the timing to perform the second operation based on a condition of conveyance of a sheet conveyed from the image forming apparatus to the post-process apparatus in succession to a sheet on which the first operation is to be performed.

Preferably, the first operation portion performs the first operation on each of a plurality of sheets based on the job. In changing the timing to perform the second operation, when the control unit determines that the second operation cannot be performed before completion of the first operation on the plurality of sheets, the control unit controls the second operation portion to perform the second operation before completion of the first operation onto the plurality of sheets, by increasing a distance between the sheets.

Preferably, the control unit prioritizes the second operation over the first operation by changing the timing to perform the first operation.

Preferably, the second operation is an operation on the manually inserted sheet. The second operation portion is movable through a prescribed path based on a command from the control unit, and when the second operation portion performs the second operation, the second operation portion is temporarily held at a prescribed position on the prescribed path. When the second operation is performed while the image forming apparatus and the post-process apparatus are not operating, the control unit controls holding power to hold the second operation portion at the prescribed position to be stronger than while the image forming apparatus and the post-process apparatus are operating.

Preferably, the first operation is a post-process on the sheet conveyed from the image forming apparatus.

Preferably, the post-process is a punching operation to punch the sheet conveyed from the image forming apparatus, an auto-stapling operation to automatically staple the sheet conveyed from the image forming apparatus, or a center fold operation to fold the sheet conveyed from the image forming apparatus.

Preferably, when the first operation is an operation different from a post-process on the sheet and when the control unit determines that the timing to perform the first operation at least partially coincides with the timing to perform the second operation, the control unit changes the timing to perform the first operation.

Preferably, when the timing to perform the first operation is changed and when an error associated with the second operation occurs to result in failure in completion of the second operation, the control unit controls the first operation portion to perform the first operation without waiting for completion of the second operation.

Preferably, the post-process apparatus further includes an exit tray where the sheet conveyed from the image forming apparatus is ejected. The first operation is an operation to move upward and downward the exit tray.

Preferably, the second operation is a manual stapling process.

Preferably, when the control unit determines that a total value of electric power for driving the first operation portion and electric power for driving the second operation portion exceeds a predetermined value, the control unit determines operation timing of the first operation portion or operation timing of the second operation portion such that the total value is equal to or smaller than the predetermined value.

An image forming system includes the above-described post process apparatus and the above-described image forming apparatus.

A method of controlling a post-process apparatus includes accepting, by a first operation portion, a sheet conveyed from an image forming apparatus and performing, by the first operation portion, a designated first operation, accepting, by a second operation portion, a sheet manually inserted into the post-process apparatus and performing, by the second operation portion, a second operation different from the first operation, and determining timing to perform the second operation in accordance with a condition of the first operation performed.

Disclosure II

A. Introduction (1) The present disclosure relates to a post-process apparatus capable of performing a post-process such as binding with a staple or punching of a sheet inserted from the outside and a method of holding a post-process portion that performs a post-process, for holding the post-process portion at a prescribed post-process position.

(2) A post-process apparatus that performs a post-process such as binding with a staple (stapling) or punching of a printed sheet conveyed from an image forming apparatus has conventionally been known. A post-process apparatus that includes a sheet insertion portion and performs a manual stapling function to perform a stapling process on inserted sheets as a user inserts the sheets from the outside into the sheet insertion portion has been proposed as such a post-process apparatus.

(3) The post-process apparatus disclosed in Japanese Laid-Open Patent Publication No. 2017-227929 described above merely describes a basic operation about manual stapling and it does not discuss any defects in continuous manual stapling.

For example, in stapling sheets successively conveyed a plurality of times from the image forming apparatus, the post-process is performed in a stable manner in the inside of the post-process apparatus and hence a position of stapling is not displaced. In manual stapling for stapling sheets inserted from the outside into the sheet insertion portion, however, a stapling process portion basically performs stapling as being moved to a position toward the outside which is close to a housing of the post-process apparatus. In other words, manual stapling is performed at a position closer to the outside which is unstable against load applied by the stapling process portion or vibration during stapling, and hence the position of manual stapling may be displaced after manual stapling is performed.

When next manual stapling is performed with the position being displaced, an unfavorable condition such as a wrong position of binding with a staple or missed stapling (air shot) is disadvantageously caused. Such a problem is a common problem that similarly occurs not only in stapling but also in the post-process such as punching.

The present disclosure was made in view of such technical backgrounds, and provides a post-process apparatus including a post-process portion that performs a post-process on a sheet inserted from the outside into a sheet insertion portion, the post-process apparatus being capable of preventing position displacement of the post-process portion due to the post-process, and a method of holding the post-process portion.

B. Contents of Disclosure

An embodiment of this disclosure will be described below with reference to the drawings.

Figure 16:
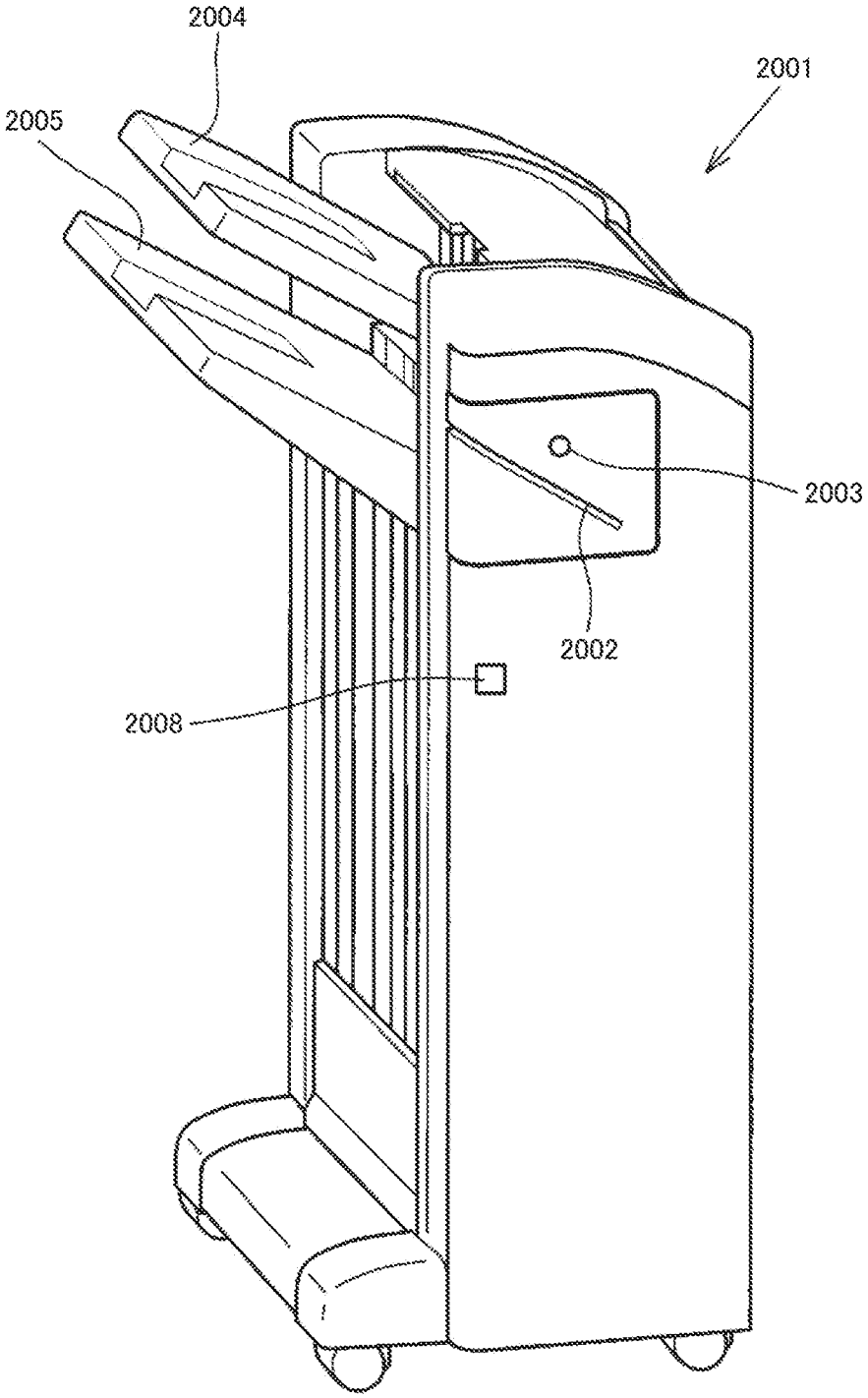
FIG. 16 is a perspective view of an appearance of a post-process apparatus according to one embodiment of this disclosure.

FIG. 16 is a perspective view of an appearance of a post-process apparatus 2001 in one embodiment of this disclosure. Post-process apparatus 2001 is connected to a downstream side of a not-shown image forming apparatus and can perform a post-process (corresponding to a second post-process) such as binding with a staple (stapling) and punching (hole punch) of printed paper (corresponding to a sheet) printed in the image forming apparatus and conveyed from the image forming apparatus.

Post-process apparatus 2001 performs a function to perform a post-process (corresponding to the first post-process) also on paper inserted from the outside into a paper insertion portion 2002 by a user, instead of paper conveyed from the image forming apparatus.

Figure 17:
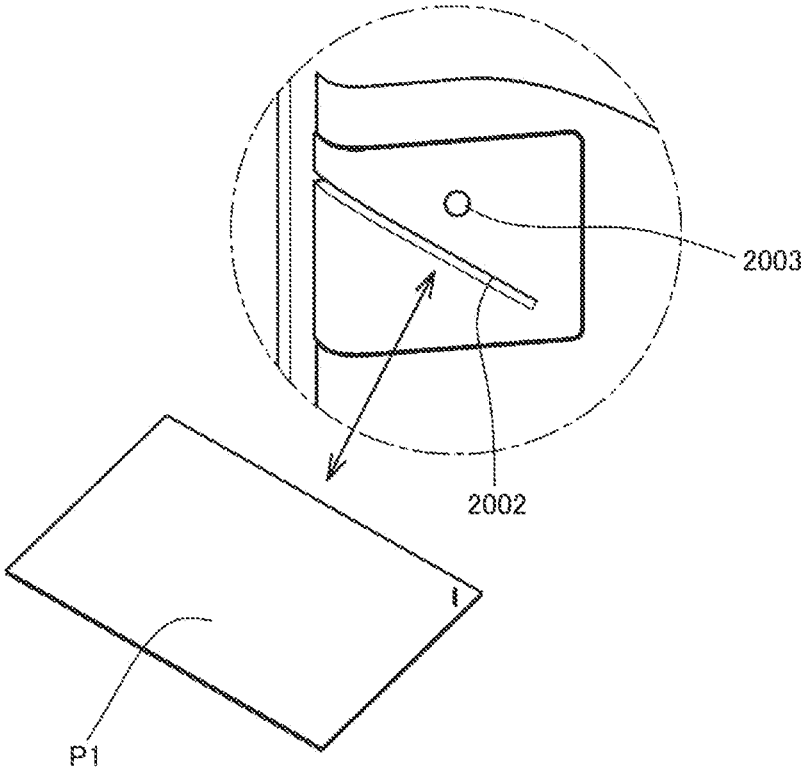
FIG. 17 is an enlarged view of an area around a sheet insertion portion in FIG. 16.

As shown in FIG. 16, post-process apparatus 2001 includes in a side surface portion, paper insertion portion 2002 in a form of a slit. As shown in FIG. 17 which is an enlarged view of an area around paper insertion portion 2002, a user inserts a plurality of sheets of paper P1 from the outside into paper insertion portion 2002, and the post-process is performed on a corner of paper P1. A front surface portion of post-process apparatus 2001 is provided with a motion sensor 2008 that senses approach by a human to post-process apparatus 2001. A known sensor may be employed as motion sensor 2008.

In this embodiment, though an example in which stapling is performed as the post-process on paper P1 inserted by a user from the outside into paper insertion portion 2002 is described, the example can naturally be applied to the post-process other than stapling. In the description below, stapling of paper P1 inserted by the user from the outside into paper insertion portion 2002 is also called manual stapling.

FIGS. 16 and 17 show an indicator 2003 that indicates whether or not manual stapling can be performed, an upper paper ejection tray 2004, and a main tray 2005.

Figure 18:
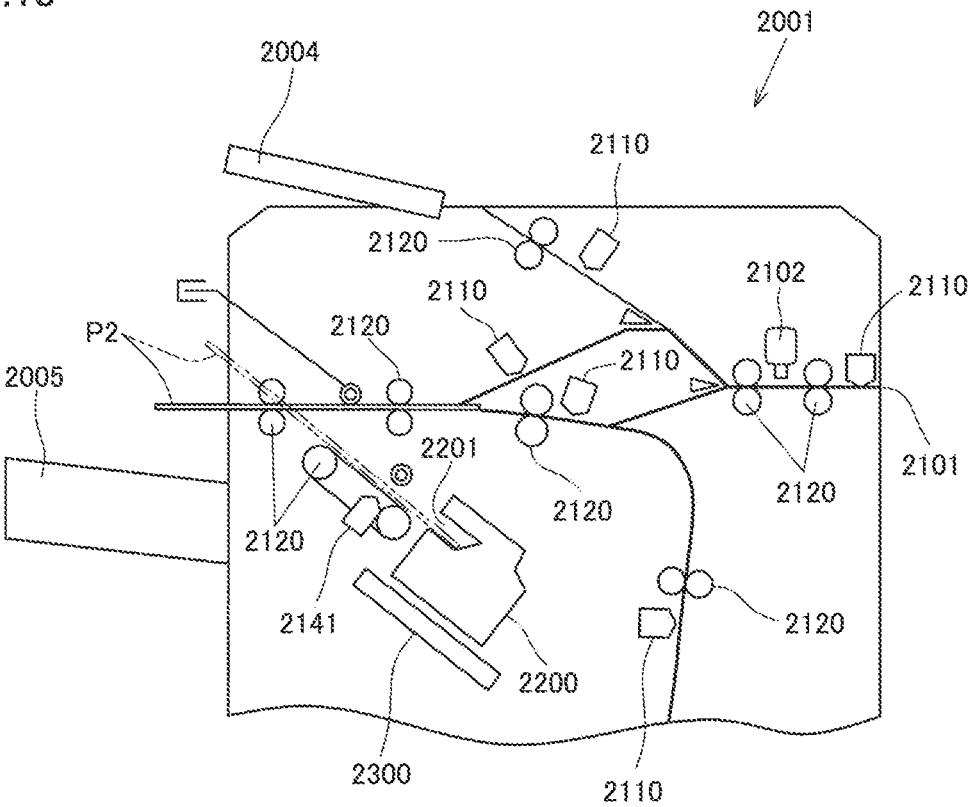
FIG. 18 is a diagram showing an internal construction of a main portion of the post-process apparatus.

FIG. 18 is a diagram showing an internal construction of a main portion of post-process apparatus 2001. In FIG. 18, a not-shown image forming apparatus is connected to the right side of post-process apparatus 2001, and paper conveyed from the image forming apparatus is taken in from a paper intake portion 2101.

A punching portion 2102 for hole punch is provided in the vicinity of paper intake portion 2101. When punching is performed as the post-process, punching portion 2102 operates on paper taken into paper intake portion 2101. After the paper is punched, the paper is ejected to upper paper ejection tray 2004.

When a plurality of sheets of paper P2 taken into paper intake portion 2101 are subjected to a staple binding process as the post-process, the sheets of paper are conveyed forward (to the left in FIG. 18) and inclined. Then, lower end portions of inclined sheets of paper P2 are fitted into a recess 2201 of a stapler 2200 which is the post-process portion, subjected to the staple binding process by stapler 2200, and ejected to main tray 2005.

Since the punching process by punching portion 2102, the staple binding process by stapler 2200, and a paper ejection process after each process have been known, detailed description will not be provided. FIG. 18 shows various sensors 2110, and shows, in particular, a paper detection sensor 2141 that detects paper inserted in paper insertion portion 2002 in manual stapling and various rollers 2120 that convey paper or the like.

Stapler 2200 described above is supported by a support plate 2300. Support plate 2300 extends in a front-rear detection (a direction of a thickness with respect to a sheet plane in FIG. 18) as being obliquely inclined with respect to a horizontal plane and a vertical plane. Stapler 2200 is movably attached in the front-rear direction (the direction of the thickness with respect to the sheet plane in FIG. 18) along support plate 2300 as being inclined with respect to the horizontal plane and the vertical plane over an inclined upper surface of inclined support plate 2300.

Stapler 2200 not only staples paper P2 conveyed from the image forming apparatus but also performs manual stapling. In the staple binding process for paper P2 conveyed from the image forming apparatus, stapler 2200 moves to a portion deep inside post-process apparatus 2001 along support plate 2300, in other words, toward the deep side with respect to the sheet plane in FIG. 18. In manual stapling, stapler 2200 moves toward the outside of post-process apparatus 2001 along support plate 2300, in other words, to an outside position close to the housing of post-process apparatus 2001 in a front side of the sheet plane in FIG. 18. Therefore, stapler 2200 moves along support plate 2300 over support plate 2300 depending on whether or not it should perform stapling of paper P2 conveyed from the image forming apparatus or manual stapling of paper P1 inserted in paper insertion portion 2002.

Figure 19:
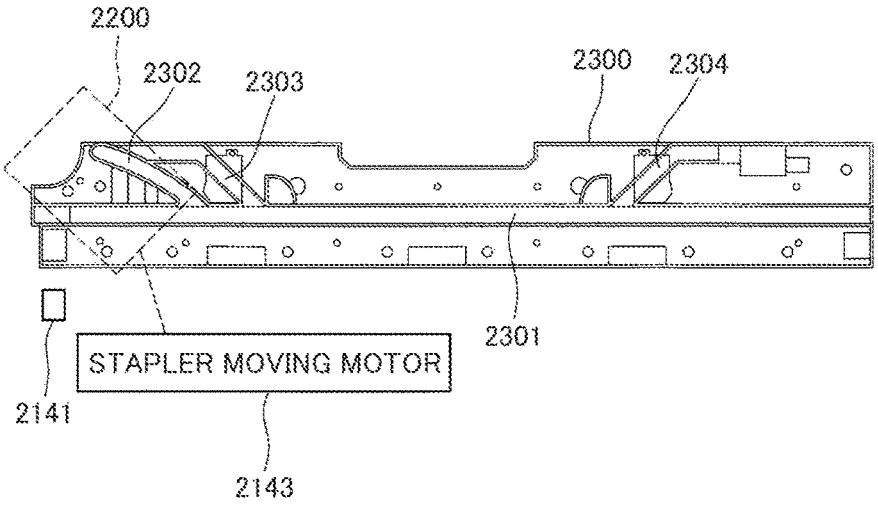
FIG. 19 is a diagram of a support plate that supports a post-process portion when viewed in a direction at a right angle with respect to a support surface of the support plate.
Figure 20:
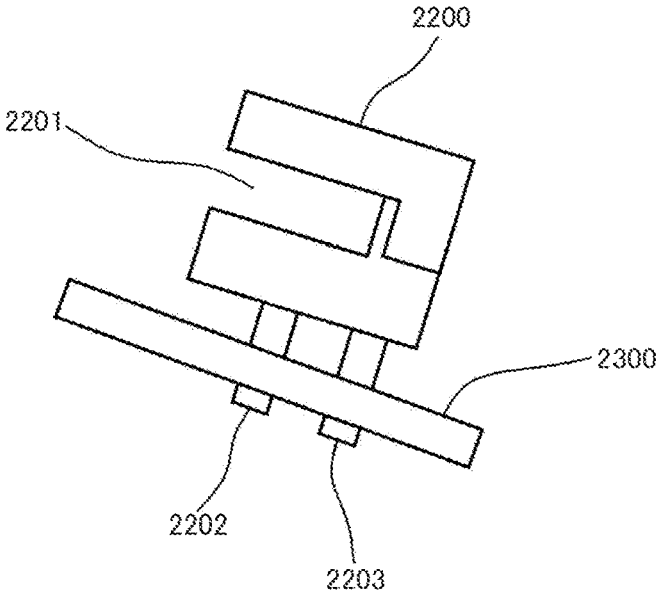
FIG. 20 is a diagram of the support plate and the post-process portion when viewed from a tip end side in a length direction in FIG. 19.
Figure 21:
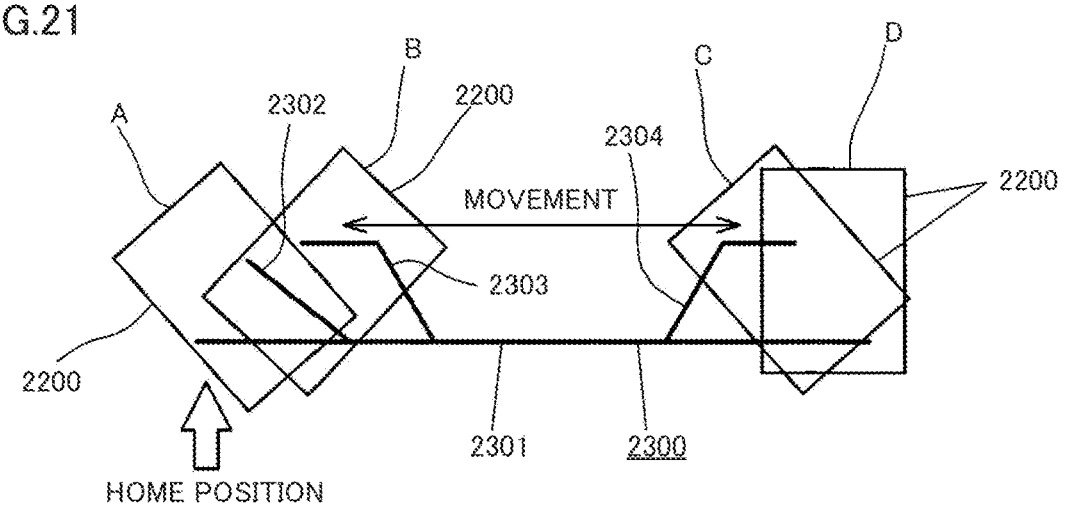
FIG. 21 is a diagram schematically showing relation between a position of the post-process portion on the support plate and a posture of attachment of the post-process portion.

FIG. 19 is a diagram of support plate 2300 viewed in a direction at a right angle with respect to the support surface of support plate 2300. A left end side (a tip end side below) in a length direction is located on the outer side close to the housing of post-process apparatus 2001 and a right end side (which is called a base end side below) is located in the portion deep inside post-process apparatus 2001. FIG. 20 is a diagram of support plate 2300 and stapler 2200 when viewed from the tip end side in the length direction in FIG. 19 and FIG. 21 is a diagram schematically showing relation between a position of stapler 2200 on support plate 2300 and a posture of attachment of stapler 2200.

As shown in FIG. 20, stapler 2200 has a first leg 2202 and a second leg 2203 protruding on a lower surface of a bracket-shaped main body including recess 2201 into which paper P1 is fitted, and stapler 2200 is coupled and supported by support plate 2300 while it is inclined at substantially the same angle as support plate 2300 with respect to the horizontal plane and the vertical plane. Since support plate 2300 and stapler 2200 are thus inclined with respect to the horizontal plane and the vertical plane, a lateral dimension of support plate 2300 and stapler 2200 can be reduced, a degree of freedom in setting is enhanced, and they can be set with a space being saved. As stapler 2200 is inclined, paper P1 obliquely inserted in paper insertion portion 2002 can reliably be guided to recess 2201.

As shown in FIG. 19, in support plate 2300, a first guide 2301 like a groove is provided along the length direction in a substantially central portion in a width direction, and a second guide 2302, a third guide 2303, and a fourth guide 2304 that communicate with first guide 2301 and obliquely extend toward an inclined upper side (an upper side in FIG. 19) in the width direction of support plate 2300 are provided at prescribed positions in the length direction, respectively. As shown in FIGS. 19 and 21, second guide 2302 extends as being inclined from first guide 2301 toward the tip end at a position close to the tip end side of support plate 2300. Third guide 2303 extends as being inclined toward the tip end at a position close the base end side relative to second guide 2302 and further extends toward the tip end in parallel to first guide 2301. Fourth guide 2304 extends as being inclined from first guide 2301 toward the base end at a position close to the base end of support plate 2300 and further extends toward the base end in parallel to first guide 2301.

Stapler 2200 is constructed such that first leg 2202 and second leg 2203 are fitted into first guide 2302 and the stapler is moved by a stapler moving motor 2143 implemented by a stepping motor in the length direction of support plate 2300 along first guide 2301 while legs 2202 and 2203 are guided by first guide 2301. Legs 2202 and 2203 are also guided from first guide 2301 to second guide 2302, third guide 2303, and fourth guide 2304. Depending on combination between legs 2202 and 2203 and guides 2301 to 2304, various postures at angles different with respect to a direction of movement of stapler 2200 can be taken at positions different in the direction of movement of stapler 2200 as shown in FIG. 21.

When stapler 2200 is located at the position on the tip end side of support plate 2300 as shown in FIG. 21, stapler 2200 holds a posture A inclined toward the left with respect to the direction of movement, and manual stapling is performed at this position. In this embodiment, this position is defined as the home position which is a position when stapler 2200 stands by. By holding inclined posture A, manual stapling is facilitated.

As third guide 2303 is used, stapler 2200 holds a posture B inclined toward the right at a position slightly distant from the tip end side of support plate 2300. At this position, the staple binding process is performed at a position at 45 degrees on a front side of paper P2 conveyed from the image forming apparatus.

As fourth guide 2304 is used, stapler 2200 holds a posture C inclined toward the left at a position slightly distant from the base end side of support plate 2300. At this position, the staple binding process is performed at a position at 45 degrees on a rear side of paper P2 conveyed from the image forming apparatus.

When stapler 2200 proceeds toward the base end side of support plate 2300, the stapler holds an upright posture D without being inclined. At this position, the staple binding process is performed at positions in parallel on the rear side of paper P2 conveyed from the image forming apparatus.

Depending on a width of paper P2 conveyed from the image forming apparatus, a mode, or whether or not manual stapling is to be performed, stapler 2200 is moved by stapler moving motor (corresponding to holding means) 2143 and can switch among postures A to D.

At the position taken with the posture (A to D) being changed, that is, the position where stapler 220 performs manual stapling of paper P1 and the position where stapler 2200 performs the staple binding process on paper P2 conveyed from the image forming apparatus, stapler 2200 is held at each process position by supply of holding electric power to stapler moving motor 2143 to feed a holding current, so that position displacement while stapler 2200 is performing the staple binding process is prevented.

Figure 22:
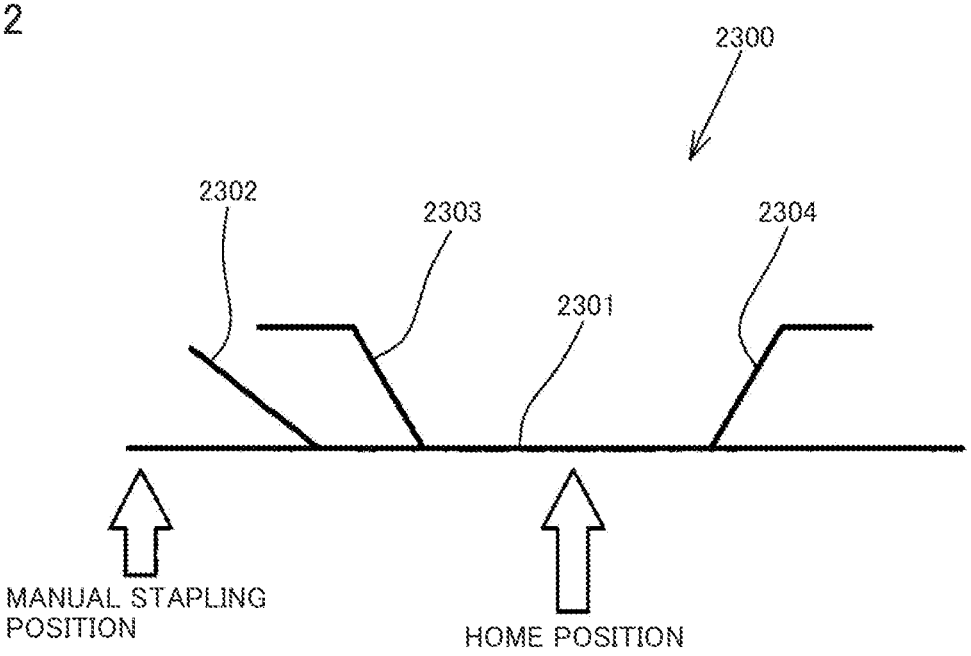
FIG. 22 is a diagram showing a modification of a home position of the post-process portion.

In the example in FIGS. 19 to 21, the position on the tip end side of support plate 2300, that is, the position at which the manual stapling process is performed is described as the home position of stapler 2200. As shown in FIG. 22, however, a position in a central portion in the direction of movement of stapler 2200 or a position on the base end side may be set as the home position.

Figure 23:
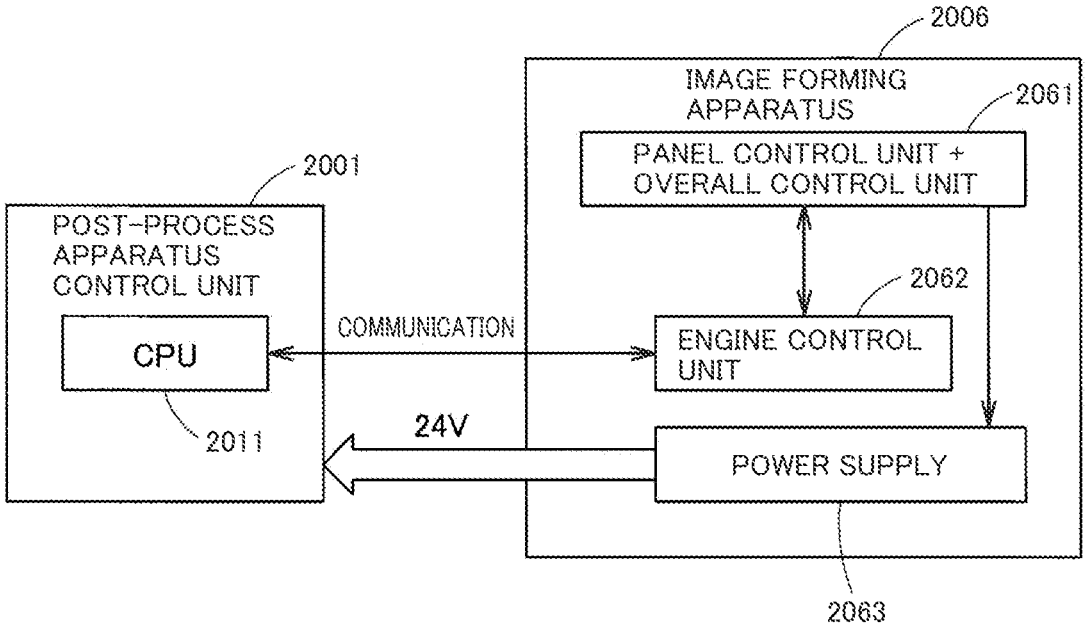
FIG. 23 is a block diagram showing a configuration of a control unit of an image forming apparatus and a control unit of the post-process apparatus.

FIG. 23 is a block diagram showing a configuration of a control unit of an image forming apparatus 2006 and a control unit of post-process apparatus 2001.

As shown in FIG. 23, image forming apparatus 2006 includes a panel control unit and overall control unit 2061, an engine control unit 2062, and a power supply 2063. Panel control unit and overall control unit 2061 controls a control panel of image forming apparatus 2006 and controls the entire image forming apparatus 2006 in a centralized manner Engine control unit 2062 controls an image forming operation by an image forming portion (an engine portion).

Post-process apparatus 2001 includes a post-process apparatus control unit that controls overall operations by post-process apparatus 2001 and the post-process apparatus control unit includes a CPU 2011. CPU 2011 has a post-process performed on paper P2 having an image formed thereon and conveyed from image forming apparatus 2006 while CPU 2011 communicates with engine control unit 2062 of image forming apparatus 2006. A voltage of 24 V is supplied from power supply 2063 of image forming apparatus 2006 to post-process apparatus 2001.

Figure 24:
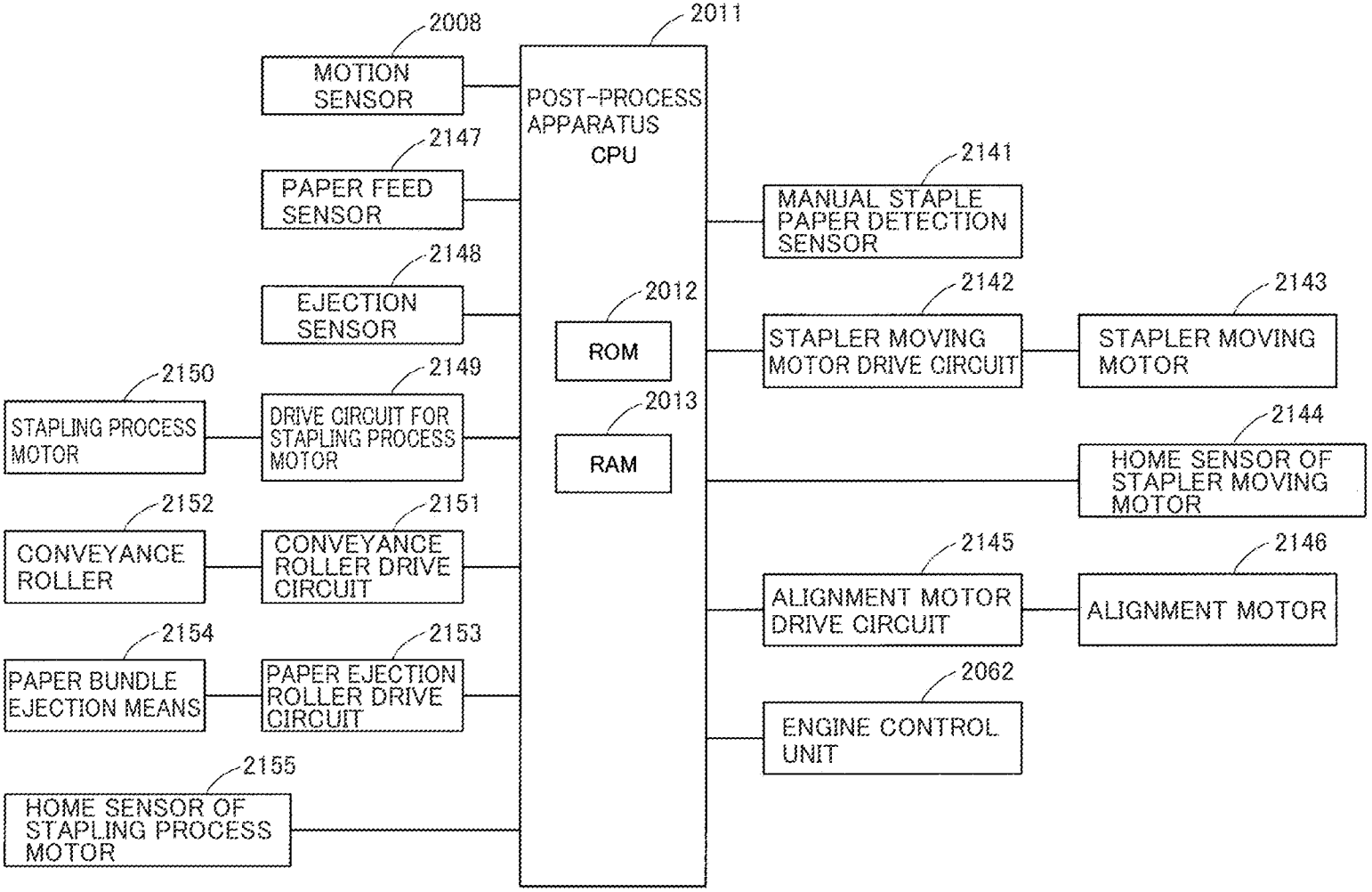
FIG. 24 is a block diagram showing a system configuration of the post-process apparatus.

FIG. 24 is a block diagram showing a system configuration of post-process apparatus 2001.

CPU 2011 described previously is mounted on a substrate of post-process apparatus 2001. CPU 2011 includes a ROM 2012 and a RAM 2013. Firmware (a program) for operations is stored in ROM 2012.

CPU 2011 receives signals from motion sensor 2008, a manual stapling paper detection sensor 2141, a home sensor 2144 that detects whether or not stapler 2200 is located at the home position by means of stapler moving motor 2143, engine control unit 2062 of image forming apparatus 2006, a paper feed sensor 2147 that detects paper P2 conveyed from image forming apparatus 2006, an ejection sensor 2148 that detects ejection of post-processed paper P2, and a home sensor 2155 that detects whether or not a stapling process motor 2150 for the stapling process by stapler 2200 is located at the home position. CPU 2011 has a stapler moving motor drive circuit 2142 drive stapler moving motor 2143 and has an alignment motor drive circuit 2145 drive an alignment motor 2146. Furthermore, the CPU has a stapling process motor drive circuit 2149 drive a staple process motor 2150, has a conveyance roller drive circuit 2151 drive a conveyance roller 2152, and has a paper ejection roller drive circuit 2153 drive paper bundle ejection means 2154 for ejecting a bundle of post-processed paper.

CPU 2011 controls an input to and an output from post-process apparatus 2001 through a program on ROM 2012 of post-process apparatus 2001. Though a processing routine is provided for each load, this is common and detailed description thereof is not provided.

Manual staple paper detection sensor 2141 is implemented by a transmissive optical sensor, and provided in the inside of paper insertion portion 2002 of post-process apparatus 2001, at a position at which paper P1 inserted in paper insertion portion 2002 is detected. With variation in result of detection by manual staple paper detection sensor 2141, determination as insertion of paper P1 into paper insertion portion 2002 is made. The sensor capable of detecting paper P1 is not limited to the transmissive optical sensor. For example, an ultrasonic sensor, a reflective optical sensor, or a touch sensor may be applicable.

Insertion of paper P1 into paper insertion portion 2002 should only be sensed. Therefore, limitation to sensing by the sensor is not intended. For example, a button (a hardware button or a software button) may be provided around paper insertion portion 2002 or in the control panel of image forming apparatus 2006, and determination as insertion of paper P1 may be made when the button is pressed.

Figure 25:
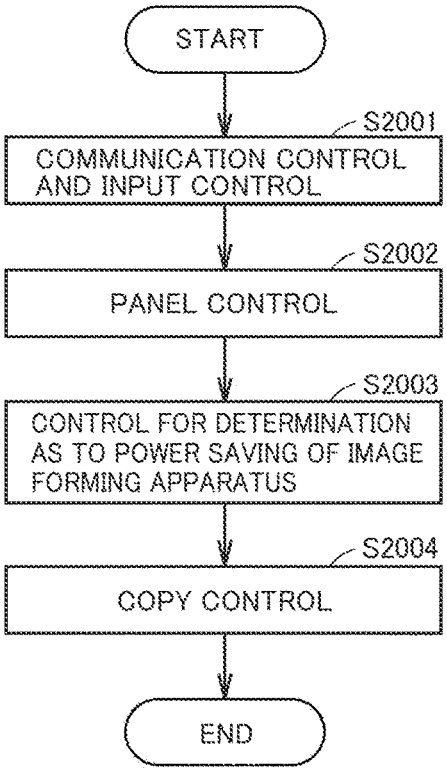
FIG. 25 is a flowchart showing an operation by the image forming apparatus.

FIG. 25 is a flowchart showing an operation by image forming apparatus 2006.

In step S2001, communication with a terminal device or post-process apparatus 2001 is controlled and input such as reception of a print job from the terminal device is controlled. In step S2002, control of the panel such as acceptance of an input of a copy job through the control panel is carried out. In step S2003, determination as to power saving such as recovery from a sleep mode or transition to the sleep mode is controlled. In step S2004, control of copying such as formation and output of an image is carried out.

Figure 26:
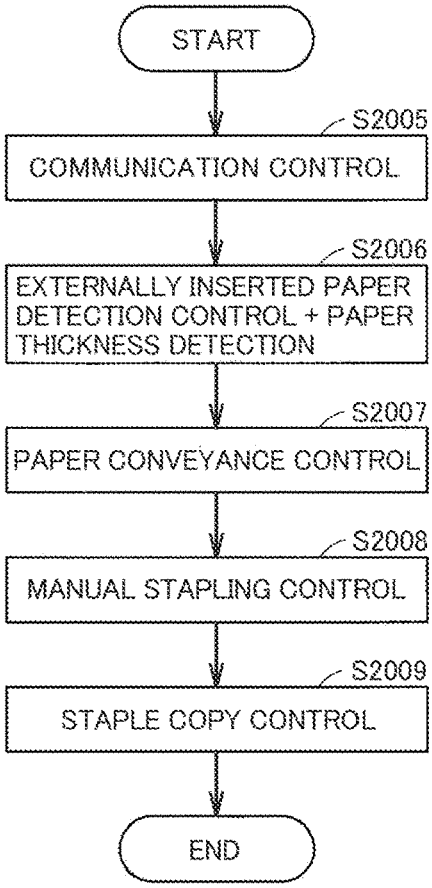
FIG. 26 is a flowchart showing an operation by the post-process apparatus.

FIG. 26 is a flowchart showing an operation by post-process apparatus 2001.

In step S2005, communication with image forming apparatus 2006 is controlled. In step S2006, detection of paper P1 inserted from the outside into paper insertion portion 2002 and detection of a thickness of paper P1 when the paper is inserted are controlled.

Then, in step S2007, conveyance of printed paper P2 conveyed from image forming apparatus 2006 is controlled. In step S2008, manual stapling is controlled. In step S2009, stapling (which is also called staple copying) of printed paper P2 is controlled.

Operations in the manual stapling process by post-process apparatus 2001 will now be described.

As described previously, stapler 2200 is used in common in both of manual stapling and staple copying, and is moved by stapler moving motor 2143 along support plate 2300 between a manual stapling position and a staple copying position.

As described previously, in order to facilitate stapling of paper P1 inserted from the outside into paper insertion portion 2002, stapler 2200 is arranged in a state inclined with respect to the horizontal plane and the vertical plane and holds posture A inclined with respect to the direction of movement of stapler 2200 on the tip end side of the support plate which is the manual stapling position. In addition, during stand-by, in order to prevent increase in temperature of stapler moving motor 2143 and to suppress a current, excitation of stapler moving motor 2143 is turned off. In other words, a holding current is not fed. For such reasons, in manual stapling, load of stapler 2200 tends to be applied to support plate 2300 and vibration is likely. Therefore, position displacement from the manual stapling position of stapler 2200 is likely.

Then, in this embodiment, in order to prevent position displacement from the manual stapling position of stapler 2200 at the time when manual stapling is performed, a holding current for stapler moving motor 2143 is fed and magnitude of holding electric power for feeding the holding current is set to magnitude at which position displacement can be prevented.

Though the holding current may be fed also during stand-by, in this case, magnitude of holding electric power in manual stapling is desirably set to be larger than magnitude during stand-by. Position displacement of stapler 2200 in manual stapling can thus be prevented while consumption of electric power during stand-by is suppressed.

First Embodiment

Figure 27:
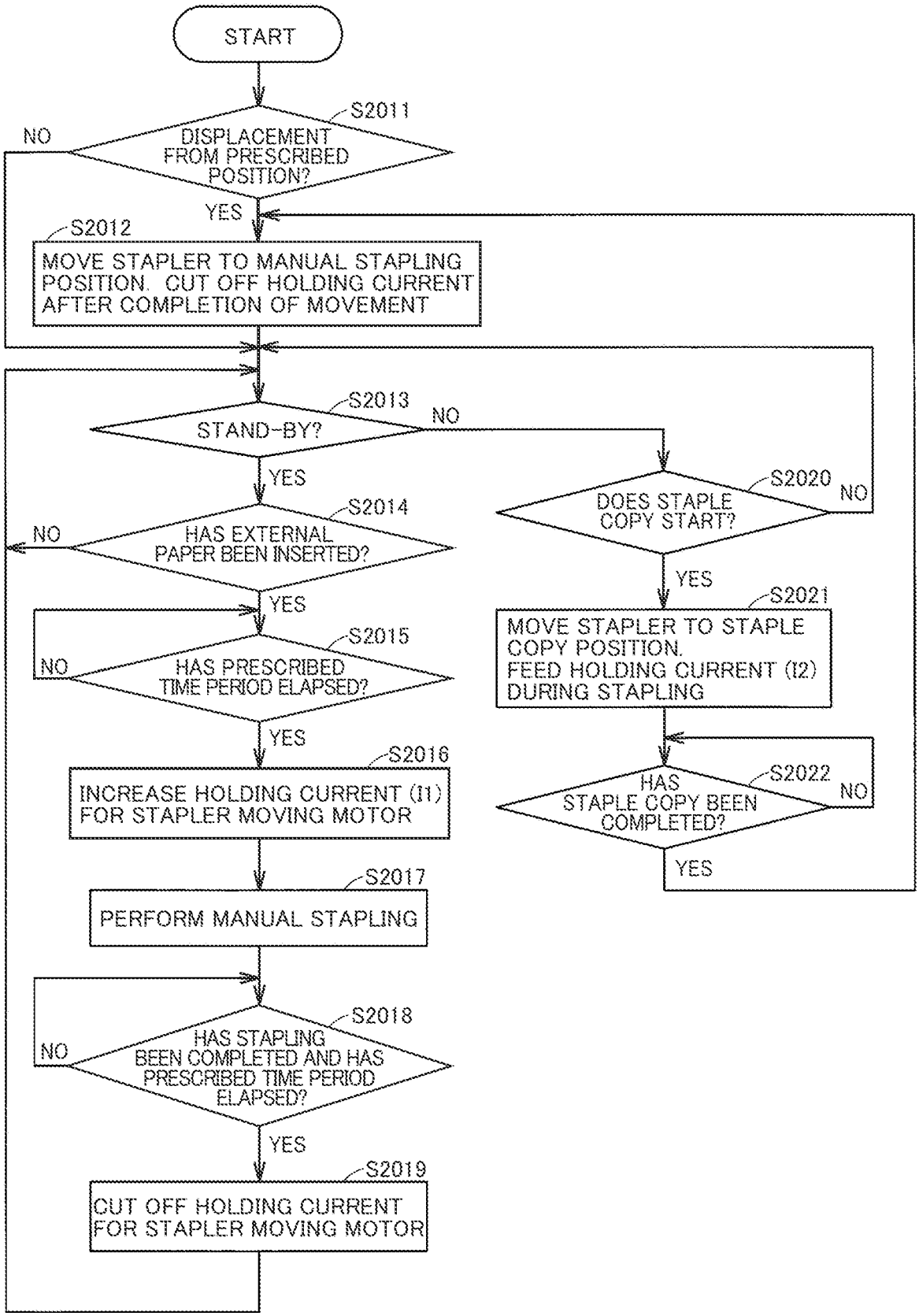
FIG. 27 is a flowchart showing an operation in a manual stapling process according to a first embodiment performed by the post-process apparatus.

FIG. 27 is a flowchart showing an operation in the manual stapling process according to a first embodiment performed by post-process apparatus 2001.

When post-process apparatus 2001 is powered on, in step S2011, whether or not stapler 2200 has been displaced from a stand-by position (home position) which is a prescribed position is determined based on an output from home sensor 2144 of stapler moving motor 2143. When the stapler has been displaced (YES in step S2011), in step S2012, stapler moving motor 2143 is driven to move the stapler to the manual stapling position which is the home position. In addition, a drive current, that is, the holding current, for stapler moving motor 2143 is cut off, and thereafter the process proceeds to step S2013. Stapler moving motor 2143 is implemented by a stepping motor and can control an amount of movement for each pulse. Therefore, an amount of movement to the home position is also readily controlled. The stapler can also readily be held at a prescribed position with the holding current.

When stapler 2200 has not been displaced from the home position in step S2011 (NO in step S2011), the process directly proceeds to step S2013.

In step S2013, whether or not the stapler stands by is checked, and when the stapler stands by (YES in step S2013), in step S2014, whether or not paper P1 has been inserted from the outside into paper insertion portion 2002 is determined based on a result of detection by paper detection sensor 2141. When no paper has been inserted (NO in step S2014), the process returns to step S2013. When paper has been inserted (YES in step S2014), in step S2015, lapse of a prescribed time period for stabilizing vibration of stapler 2200 due to insertion of paper is waited for (NO in step S2015). When the prescribed time period has elapsed (YES in step S2015), in step S2016, a holding current (I1) for stapler moving motor 2143, in other words, holding electric power for stapler moving motor 2143, is increased to magnitude at which stapler 2200 is not displaced from the manual stapling position, and thereafter in step S2017, manual stapling is performed.

Then, in step S2018, whether or not manual stapling has been completed and whether or not a prescribed time period has elapsed is determined. Lapse of the prescribed time period is waited for in order to wait for subsidence of vibration at the time of stapling. When manual stapling has not been completed or when the prescribed time period has not elapsed (NO in step S2018), the process remains in step S2018. When manual stapling has been completed and the prescribed time period has elapsed (YES in step S2018), in step S2019, the holding current for stapler moving motor 2143 is cut off and the process returns to step S2013.

Thus, in this embodiment, in performing manual stapling, electric power for stapler moving motor 2143 is set to magnitude at which stapler 2200 is not displaced from the post-process position. Therefore, the position of stapler 2200 can be prevented from being displaced from the post-process position even though manual stapling is performed. Therefore, since manual stapling can be performed at an appropriate position, a defective post-process due to position displacement can be prevented.

Since electric power for stapler moving motor 2143 is set to magnitude at which stapler 2200 is not displaced from the post-process position before start of manual stapling, position displacement of stapler 2200 can be prevented in a stable manner from the time point of start of manual stapling.

Since electric power for stapler moving motor 2143 is lowered after completion of manual stapling, unnecessary power consumption can be avoided.

When the stapler does not stand by in step S2013 (NO in step S2013), in step S2020, whether or not a staple copying mode has been started is checked. When the staple copying mode has not been started (NO in step S2020), the process returns to step S2013. When the staple copying mode has been started (YES in step S2020), in step S2021, stapler 2200 is moved to a staple copying position by stapler moving motor 2143 and staple copying is performed. While staple copying is being performed, a holding current I2 is fed to stapler moving motor 2143.

Regarding magnitude of holding electric power for feeding holding current I2 to stapler moving motor 2143 during staple copying and magnitude of holding electric power for feeding holding current I1 during manual stapling, holding electric power during manual stapling is desirably set to be higher than holding electric power during staple copying. This is because a position where a manual stapling process is performed is located on the tip end side of support plate 2300, which results in large position displacement due to manual stapling, and this position displacement is to reliably be prevented.

Then, in step S2022, whether or not staple copying has fully been completed is determined. When staple copying has not been completed (NO in step S2022), completion is waited for. When staple copying has been completed (YES in step S2022), the process returns to step S2012 and stapler 2200 is moved to the manual stapling position which is the home position.

Second Embodiment

Figure 28:
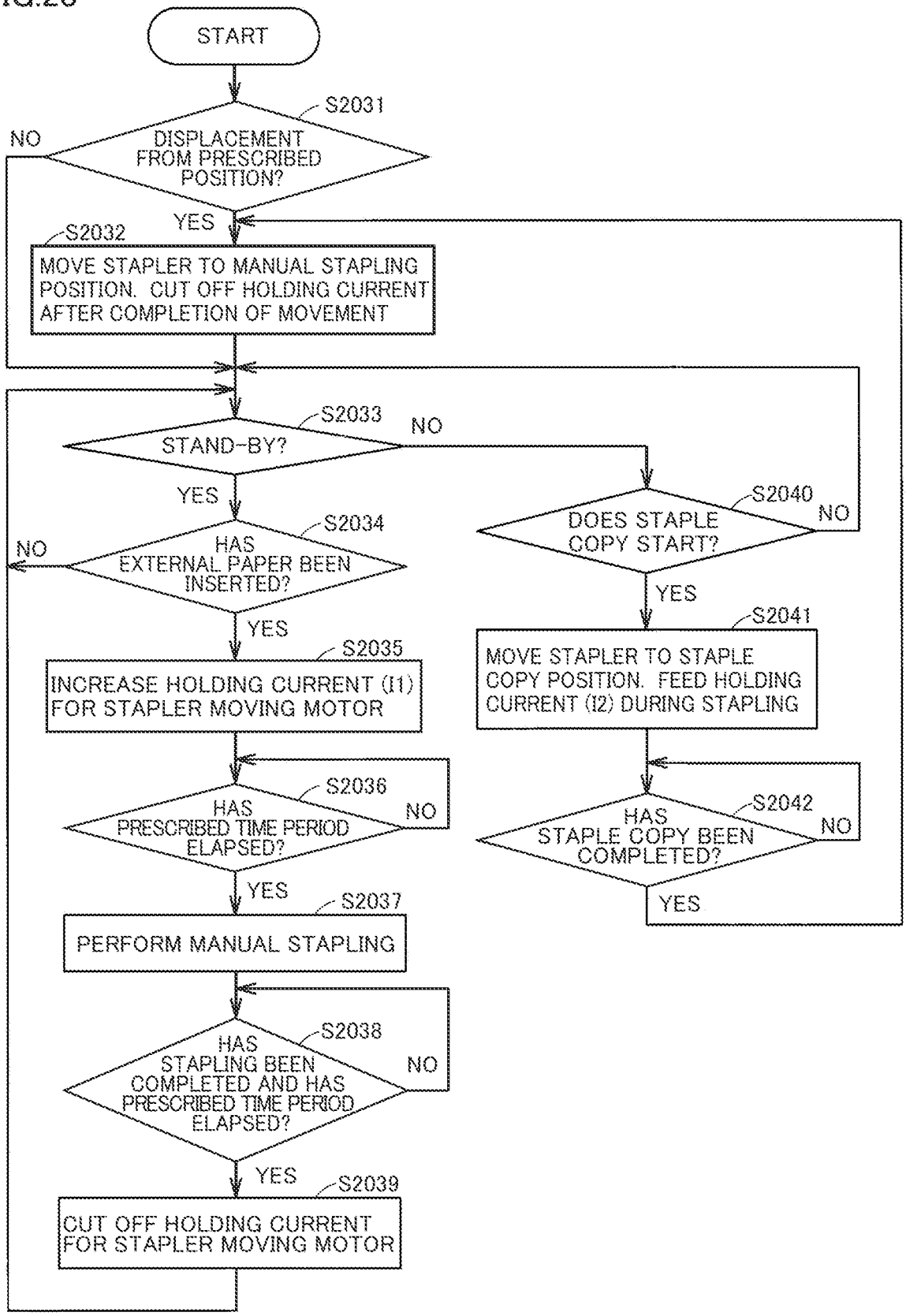
FIG. 28 is a flowchart showing an operation in the manual stapling process according to a second embodiment performed by the post-process apparatus.

FIG. 28 is a flowchart showing an operation in the manual stapling process according to a second embodiment performed by post-process apparatus 2001. In this embodiment, a holding current (holding electric power) for stapler moving motor 2143 is increased as being triggered by detection of insertion of paper (bundle of paper) P1 on which manual stapling is to be performed from the outside into paper insertion portion 2002.

When post-process apparatus 2001 is powered on, in step S2031, whether or not stapler 2200 has been displaced from a stand-by position (home position) which is a prescribed position is determined based on an output from home sensor 2144 of stapler moving motor 2143. When the stapler has been displaced (YES in step S2031), in step S2032, stapler moving motor 2143 is driven to move the stapler to the manual stapling position which is the home position. Thereafter, the process proceeds to step S2033. When stapler 2200 has not been displaced from the home position in step S2031 (NO in step S2031), the process directly proceeds to step S2033.

In step S2033, whether or not the stapler stands by is checked, and when the stapler stands by (YES in step S2033), in step S2034, whether or not paper P1 has been inserted from the outside into paper insertion portion 2002 is determined based on a result of detection by paper detection sensor 2141. When no paper has been inserted (NO in step S2034), the process returns to step S2033. When paper has been inserted (YES in step S2034), in step S2035, holding current (I1) for stapler moving motor 2143, in other words, holding electric power for stapler moving motor 2143, is increased to magnitude at which stapler 2200 is not displaced from the manual stapling position. Then, in step S2036, lapse of a prescribed time period is waited for (NO in step S2036) for stabilizing vibration of stapler 2200 due to insertion of paper. When the prescribed time period has elapsed (YES in step S2036), manual stapling is performed in step S2037.

Then, in step S2038, whether or not manual stapling has been completed and whether or not a prescribed time period has elapsed is determined. When manual stapling has not been completed or when the prescribed time period has not elapsed (NO in step S2038), the process remains in step S2038. When manual stapling has been completed and the prescribed time period has elapsed (YES in step S2038), in step S2039, the holding current for stapler moving motor 2143 is cut off and the process returns to step S2033.

Thus, in this embodiment, electric power for stapler moving motor 2143 is set to magnitude at which stapler 2200 is not displaced from the post-process position as being triggered by detection by manual staple paper detection sensor 2141 of insertion of paper P1 from the outside into paper insertion portion 2002. Therefore, stapler 2200 can be held at appropriate timing necessary for prevention of position displacement.

When the stapler does not stand by in step S2033 (NO in step S2033), in step S2040, whether or not the staple copying mode has been started is checked. When the staple copying mode has not been started (NO in step S2040), the process returns to step S2033. When the staple copying mode has been started (YES in step S2040), in step S2041, stapler 2200 is moved to the staple copying position by stapler moving motor 2143 and staple copying is performed. While staple copying is being performed, holding current I2 is fed to stapler moving motor 2143.

Holding electric power during manual stapling is desirably set to be higher than holding electric power during staple copying also in this case.

Then, in step S2042, whether or not staple copying has fully been completed is determined. When staple copying has not been completed (NO in step S2042), completion is waited for. When staple copying has been completed (YES in step S2042), the process returns to step S2032 and stapler 2200 is moved to the manual stapling position which is the home position.

Third Embodiment

Figure 29:
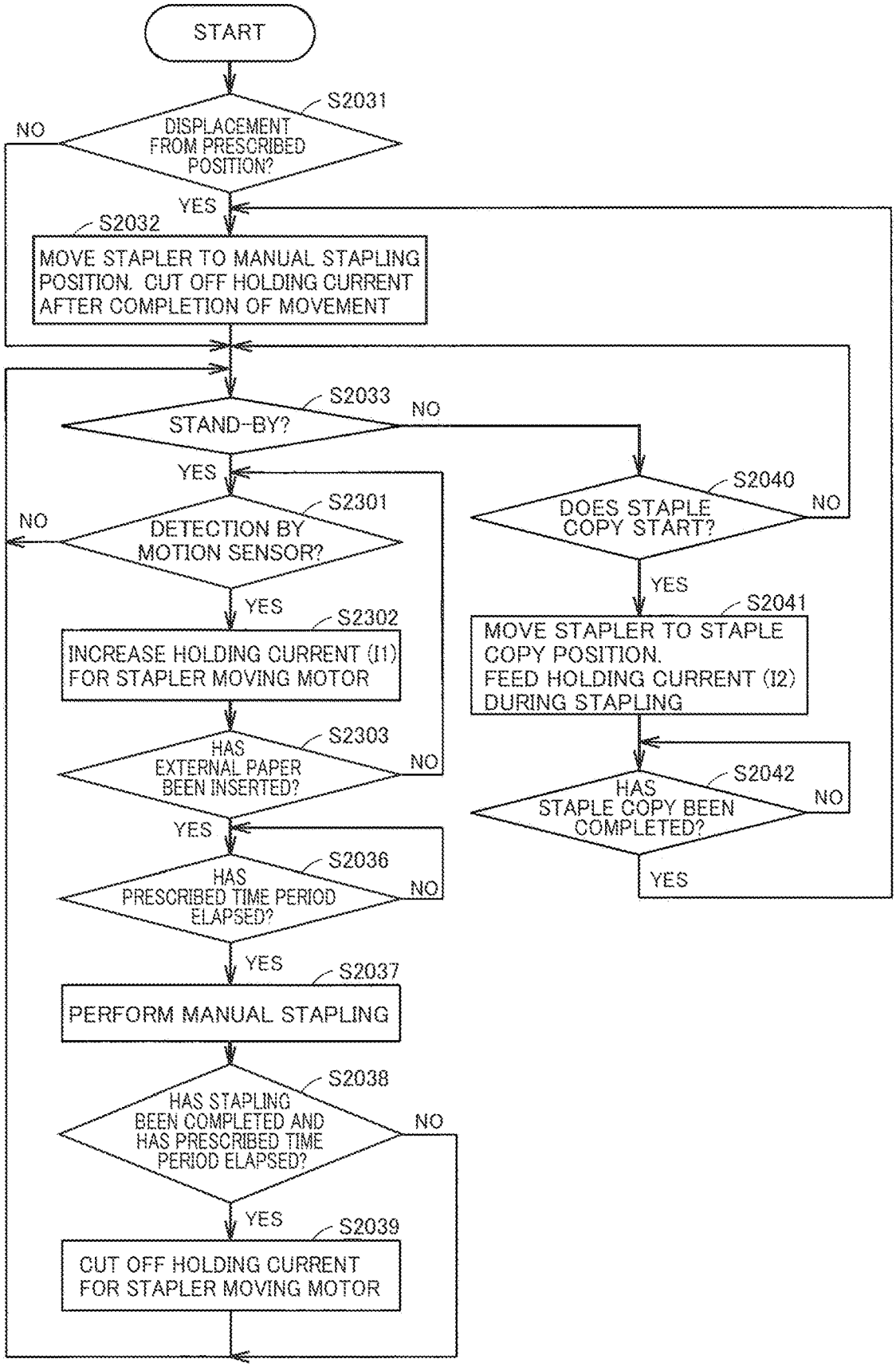
FIG. 29 is a flowchart showing an operation in the manual stapling process according to a third embodiment performed by the post-process apparatus.

FIG. 29 is a flowchart showing an operation in the manual stapling process according to a third embodiment performed by post-process apparatus 2001. In this embodiment, the holding current (holding electric power) for stapler moving motor 2143 is increased when motion sensor 2008 detects approach by a human to post-process apparatus 2001 before detection of insertion of paper P1 on which manual stapling is to be performed from the outside into paper insertion portion 2002.

In a process in FIG. 29, processing in steps S2031 to S2033 and S2036 to S2042 is the same as the processing shown in the flowchart in FIG. 28. Therefore, the same step numbers are allotted and detailed description will not be provided.

Whether or not the stapler stands by is checked in step S2033 in FIG. 29, and when the stapler stands by (YES in step S2033), in step S2301, whether or not motion sensor 2008 has detected approach by a human to the post-process apparatus is checked. When the motion sensor has detected approach (YES in step S2301), in step S2302, the holding current (I1) for stapler moving motor 2143, in other words, electric power for stapler moving motor 2143, is increased to magnitude at which stapler 2200 is not displaced from the manual stapling position. Thereafter, the process proceeds to step S2303. When the motion sensor has not detected approach by the human to the post-process apparatus (NO in step S2301), the process returns to step S2033.

In step S2303, whether or not paper P1 has been inserted from the outside into paper insertion portion 2002 is determined based on a result of detection by paper detection sensor 2141. When no paper has been inserted (NO in step S2303), the process returns to step S2301. When paper has been inserted (YES in step S2303), the process proceeds to step S2036.

Thus, in this embodiment, when approach by a human to the post-process apparatus is detected, the holding current (I1) for stapler moving motor 2143, in other words, holding electric power for stapler moving motor 2143, is increased to magnitude at which stapler 2200 is not displaced from the manual stapling position. Therefore, stapler 2200 can be held at the post-process position sufficiently before start of manual stapling.

Figure 30:
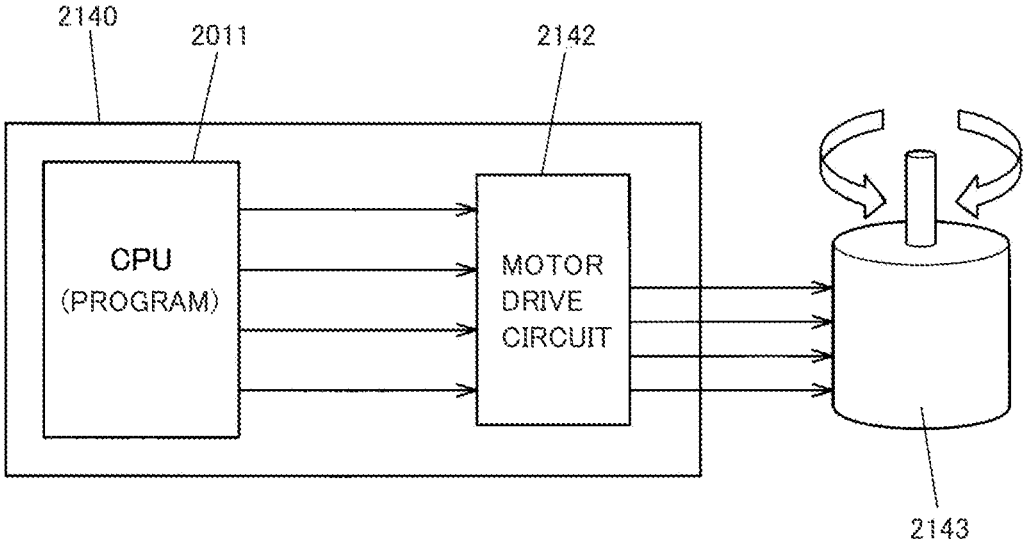
FIG. 30 is an illustration about drive of a moving motor of the post-process portion.

FIG. 30 is an illustration about drive of stapler moving motor 2143. Stapler moving motor 2143 is driven by a motor control unit 2140. Motor control unit 2140 includes CPU 2011 and motor drive circuit 2142 described previously.

CPU 2011 provides an enable signal, a rotation direction control signal, a motor current setting signal, and a clock signal to motor drive circuit 2142, and motor drive circuit 2142 drives stapler moving motor 2143 based on these signals.

When the enable signal is on, power is fed to stapler moving motor 2143. A current for stapler moving motor 2143 is set based on magnitude of a current setting signal A speed of the clock signal determines a rotation speed. A rotation direction in a forward direction or a reverse direction of stapler moving motor 2143 is set by setting of on and off of the rotation direction signal. When no clock signal is provided by setting the current setting signal and the enable signal to on, stapler moving motor 2143 does not rotate but holds its position. The holding current (holding electric power) is increased or decreased based on magnitude of the current setting signal.

Figure 31:
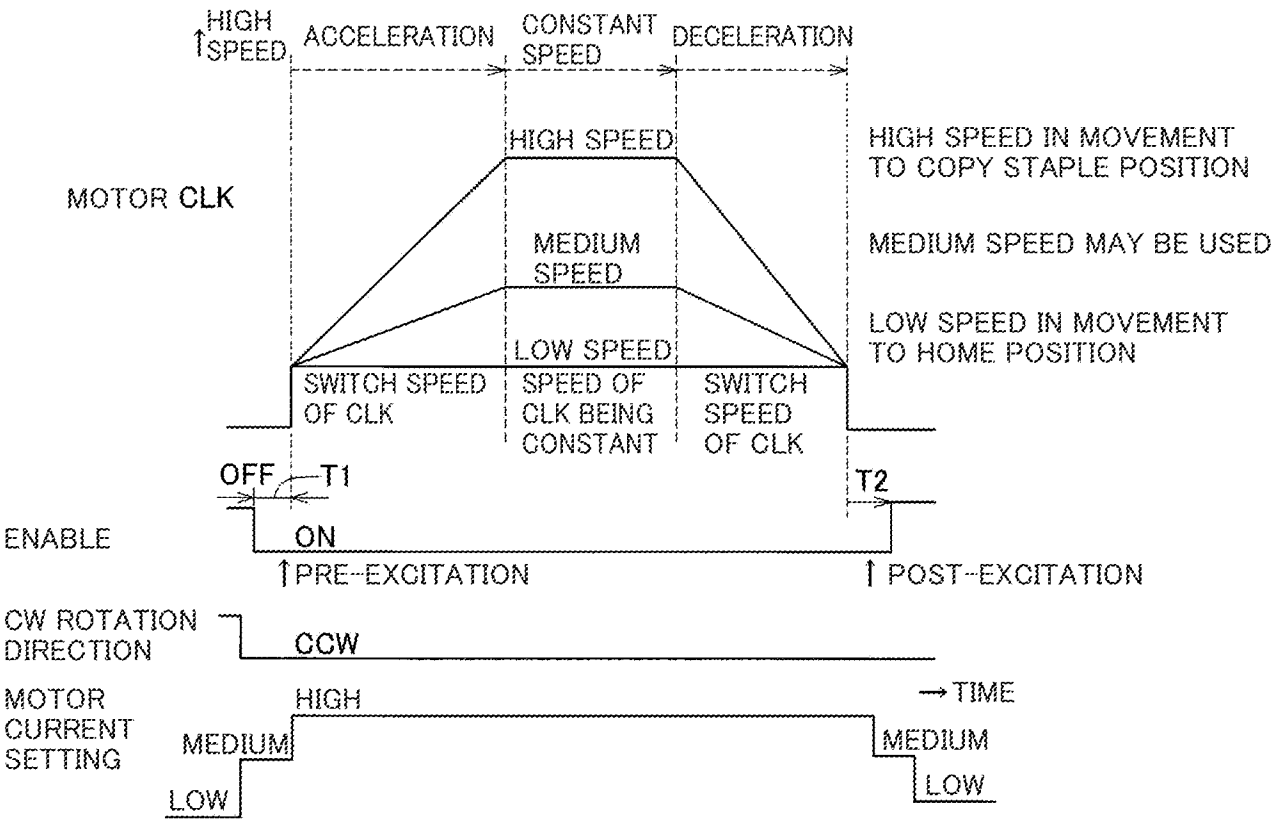
FIG. 31 is a diagram for illustrating a manner of control of a speed of the moving motor of the post-process portion.

FIG. 31 is a diagram for illustrating a manner of control of a speed of stapler moving motor 2143. When the speed of the clock signal is switched while the enable signal is on, stapler moving motor 2143 is in an accelerated state or a decelerated state. When the speed of the clock signal is set to be constant, stapler moving motor 2143 is in a constant speed state. The speed of stapler moving motor 2143 while the speed is constant is varied by magnitude of the motor current setting signal.

A method of controlling drive of stapler moving motor 2143 is not limited to the method described with reference to FIGS. 30 and 31.

In the embodiment, in performing manual stapling by stapler 2200, holding electric power for holding stapler moving motor 2143 at the post-process position is set to magnitude at which stapler 2200 is not displaced from the post-process position. A thickness detector that detects a thickness of paper P1 to be subjected to manual stapling, however, may be provided, and magnitude of holding electric power (holding current) may be switched depending on a detected thickness. An extent of position displacement is different depending on a thickness of paper P1, and position displacement is larger as paper P1 has a larger thickness. Therefore, as paper P1 has a larger thickness, higher holding electric power is set. A table in which relation between set holding electric power and a thickness of paper is defined may be prepared in post-process apparatus 2001 and holding electric power corresponding to the detected thickness of paper may be selected.

A method of detecting a thickness of paper P1 inserted in paper insertion portion 2002 is not particularly limited, and ultrasonic waves or a thickness detection sensor may be used.

Figure 32A:
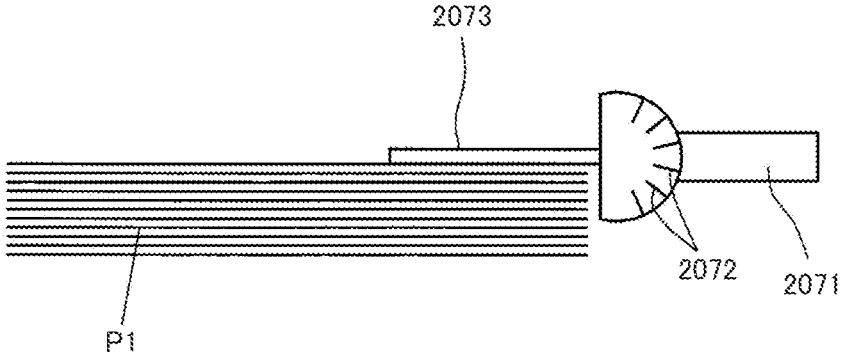
FIGS. 32A, 32B, and 32C are diagrams for illustrating a method of detecting a thickness of a sheet with a thickness detection sensor.
Figure 32B:
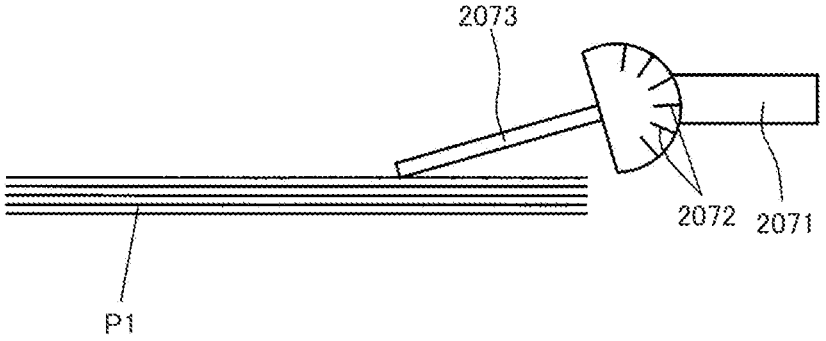
Figure 32C:
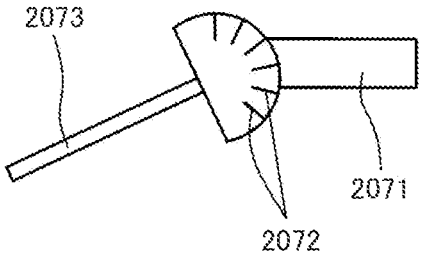

FIGS. 32A, 32B, and 32C are diagrams for illustrating a method of using a thickness detection sensor. These figures show, for example, a reflective sensor 2071 and an actuator 2073 with a tip end in a rod shape and a semicircular base end. A plurality of slits 2072 are radially provided in the base end of actuator 2073.

Actuator 2073 is biased counterclockwise, and when paper P1 is not inserted, it is pivoted to a lowermost end as shown in FIG. 32C. When paper P1 is present, the actuator is pivoted clockwise as shown in FIGS. 32A and 32B. An amount of clockwise pivot is larger in FIG. 32A in which paper P1 is larger in thickness than in FIG. 32B in which paper P1 is smaller in thickness.

With difference in amount of pivot of actuator 2073, positions of slits 2072 with respect to sensor 2071 are also different. Therefore, a thickness of paper P1 can be detected based on a position of detection of slits 2072.

A voltage in accordance with an amount of pivot of actuator 2073 may be generated, and a sensor that detects a thickness of paper based on a voltage value may be provided.

Sensor 2071 with an actuator may also serve as a sensor that detects paper P1 inserted in paper insertion portion 2002.

Though one embodiment of the present disclosure is described above, the present disclosure is not limited to the embodiment above.

For example, in the embodiment shown in FIGS. 27 to 29, an example in which the home position of stapler 2200 is the same as the manual stapling position is described. As shown in FIG. 22, however, the home position of stapler 2200 may be different from the manual stapling position. In this case, when paper detection sensor 2141 detects insertion of paper P1 into paper insertion portion 2002 or when motion sensor 2008 detects approach by a human, stapler 2200 may be moved from the home position to the manual stapling position and holding electric power may be increased.

C. Additional Aspects

The object above is achieved by means below.

(1) A post-process apparatus includes a sheet insertion portion, a post-process portion that performs at a prescribed post-process position, a first post-process on a sheet inserted from the outside into the sheet insertion portion, holding means for electrically holding the post-process portion at the prescribed post-process position, and control means for setting holding electric power for electrically holding the holding means to magnitude at which the post-process portion is not displaced from the post-process position in the first post-process by the post-process portion on the sheet inserted from the outside into the sheet insertion portion.

(2) The post-process apparatus described in preceding clause 1, wherein the post-process portion performs a second post-process on a sheet conveyed from an upstream apparatus, and the control means sets the holding electric power such that electrical holding power held by the holding means in the first post-process is larger in magnitude than electrical holding power held by the holding means in the second post-process by the post-process portion.

(3) The post-process apparatus described in preceding clause 1 or 2, wherein the control means sets the holding electric power such that electrical holding power held by the holding means in performing the first post-process is larger in magnitude than electrical holding power held by the holding means while the post-process portion stands by.

(4) The post-process apparatus described in any one of preceding clauses 1 to 3, wherein the control means sets the holding electric power to magnitude at which the post-process portion is not displaced from the post-process position before start of the first post-process.

(5) The post-process apparatus described in any one of preceding clauses 1 to 4 includes detection means for detecting insertion of the sheet from the outside into the sheet insertion portion, and the control means sets the holding electric power to magnitude at which the post-process portion is not displaced from the post-process position, as being triggered by detection of insertion of the sheet by the detection means.

(6) The post-process apparatus described in any one of preceding clauses 1 to 5 includes a motion sensor that detects approach by a human to the post-process apparatus, and when the motion sensor detects approach by the human to the post-process apparatus, the control means sets holding electric power to magnitude at which the post-process portion is not displaced from the post-process position.

(7) The post-process apparatus described in any one of preceding clauses 1 to 6 includes thickness detection means for detecting a thickness of a sheet on which the first post-process is performed, and the control means switches magnitude of holding electric power in accordance with a result of detection by the thickness detection means.

(8) The post-process apparatus described in any one of preceding clauses 1 to 7, wherein the control means lowers holding electric power after the first post-process is completed.

(9) The post-process apparatus described in any one of preceding clauses 1 to 8, wherein the post-process portion is inclined with respect to a horizontal plane when it is located at the prescribed post-process position.

(10) The post-process apparatus described in any one of preceding clauses 1 to 9, wherein the post-process portion is inclined with respect to a direction of movement of the post-process portion when it is located at the prescribed post-process position.

(11) The post-process apparatus described in any one of preceding clauses 1 to 10, wherein the first post-process is a staple binding process.

(12) A method of holding a post-process portion includes a control step of setting, when a post-process apparatus including a sheet insertion portion, a post-process portion that performs at a prescribed post-process position, a first post-process onto a sheet inserted from the outside into the sheet insertion portion, and holding means for electrically holding the post-process portion at the prescribed post-process position performs the first post-process by the post-process portion onto the sheet inserted form the outside into the sheet insertion portion, holding electric power for electrically holding the holding means to magnitude at which the post-process portion is not displaced from the post-process position.

(13) The method of holding a post-process portion described in preceding clause 12, wherein the post-process portion performs a second post-process on a sheet conveyed from an upstream apparatus, and in the control step, the holding electric power is set such that electrical holding power held by the holding means in performing the first post-process is larger in magnitude than electrical holding power held by the holding means when the post-process portion performs the second post-process.

(14) The method of holding a post-process portion described in preceding clause 12 or 13, wherein in the control step, the holding electric power is set such that electrical holding power held by the holding means in performing the first post-process is larger in magnitude than electrical holding power held by the holding means when the post-process portion stands by.

(15) The method of holding a post-process portion described in any one of preceding clauses 12 to 14, wherein in the control step, the holding electric power is set to magnitude at which the post-process portion is not displaced from the post-process position before start of the first post-process.

(16) The method of holding a post-process portion described in any one of preceding clauses 12 to 15, wherein detection means for detecting insertion of the sheet from the outside into the sheet insertion portion is provided, and in the control step, the holding electric power is set to magnitude at which the post-process portion is not displaced from the post-process position as being triggered by detection by the detection means of insertion of the sheet.

(17) The method of holding a post-process portion described in any one of preceding clauses 12 to 16, wherein a motion sensor that detects approach by a human to the post-process apparatus is provided, and in the control step, when the motion sensor detects approach by the human to the post-process apparatus, the holding electric power is set to magnitude at which the post-process portion is not displaced from the post-process position.

(18) The method of holding a post-process portion described in any one of preceding clauses 12 to 17, wherein thickness detection means for detecting a thickness of the sheet on which the first post-process is performed is provided, and the control means switches magnitude of the holding electric power in accordance with a result of detection by the thickness detection means.

(19) The method of holding a post-process portion described in any one of preceding clauses 12 to 18, wherein in the control step, the holding electric power is lowered after completion of the first post-process.

(20) The method of holding a post-process portion described in any one of preceding clauses 12 to 19, wherein the post-process portion is inclined with respect to a horizontal plane when it is located at the prescribed post-process position.

(21) The method of holding a post-process portion described in any one of preceding clauses 12 to 20, wherein the post-process portion is inclined with respect to a direction of movement of the post-process portion when it is located at the prescribed post-process position.

(22) The method of holding a post-process portion described in any one of preceding clauses 12 to 21, wherein the first post-process is a staple binding process.

According to the disclosure described in preceding clauses (1) and (12), holding means for electrically holding at a prescribed post-process position, a post-process portion that performs at the prescribed post-process position, a first post-process onto a sheet inserted from the outside into a sheet insertion portion is provided, and holding electric power for electrically holding the holding means in performing the first post-process is set to magnitude at which the post-process portion is not displaced from the post-process position. Therefore, the position of the post-process portion can be prevented from being displaced from the post-process position even when the first post-process is performed. Therefore, since the first post-process can be performed at an appropriate position, a defective post-process due to position displacement can be prevented.

According to the disclosure described in preceding clauses (2) and (13), the post-process portion performs a second post-process onto a sheet conveyed from an upstream apparatus, and holding electric power is set such that electrical holding power held by the holding means in performing the first post-process is larger in magnitude than electrical holding power held by the holding means when the post-process portion performs the second post-process. Therefore, position displacement of the post-process portion in performing the first post-process can more reliably be prevented.

According to the disclosure described in preceding clauses (3) and (14), holding electric power is set such that electrical holding power held by the holding means in performing the first post-process is larger in magnitude than electrical holding power held by the holding means when the post-process portion stands by. Therefore, position displacement of the post-process portion when the first post-process is performed can be prevented while power consumption during stand-by is suppressed.

According to the disclosure described in preceding clauses (4) and (15), holding electric power is set to magnitude at which the post-process portion is not displaced from the post-process position before start of the first post-process. Therefore, position displacement of the post-process portion can be prevented in a stable manner from the time point of start of the first post-process.

According to the disclosure described in preceding clauses (5) and (16), holding electric power is set to magnitude at which the post-process portion is not displaced from the post-process position as being triggered by detection of insertion of the sheet. Therefore, the post-process portion can be held at appropriate timing necessary for prevention of position displacement.

According to the disclosure described in preceding clauses (6) and (17), when the motion sensor detects approach by a human to the post-process apparatus, holding electric power is set to magnitude at which the post-process portion is not displaced from the post-process position. Therefore, the post-process portion can be held at appropriate timing necessary for prevention of position displacement.

According to the disclosure described in preceding clauses (7) and (18), the post-process portion can be held with appropriate holding power in accordance with a thickness of a sheet on which the first post-process is performed. Therefore, even though a thickness of a sheet is different, position displacement of the post-process portion can reliably be prevented.

According to the disclosure described in preceding clauses (8) and (19), holding electric power is lowered after completion of the first post-process. Therefore, unnecessary power consumption can be avoided.

According to the disclosure described in preceding clauses (9) and (20), the post-process portion is inclined with respect to the horizontal plane when it is located at the prescribed post-process position. Therefore, a degree of freedom in providing the post-process portion is enhanced and a sheet inserted from the outside into the sheet insertion portion is more readily post-processed.

According to the disclosure described in preceding clauses (10) and (21), the post-process portion is inclined with respect to the direction of movement of the post-process portion when it is located at the prescribed post-process position. Therefore, a degree of freedom in providing the post-process portion is enhanced and a sheet inserted from the outside into the sheet insertion portion is more readily post-processed.

According to the disclosure described in preceding clauses (11) and (22), position displacement of the post-process portion that performs a staple binding process at the post-process position onto a sheet inserted from the outside into the sheet insertion portion, from the post-process position in performing the staple binding process, can be prevented.

Although embodiments of the present disclosure have been described and illustrated in detail, the disclosed embodiments are made for the purposes of illustration and example only and not limitation. The scope of the present disclosure should be interpreted by terms of the appended claims.

As used herein, the words "can" and "may" are used in a permissive (i.e., meaning having the potential to), rather than mandatory sense (i.e., meaning must). The words "include," "includes," "including," and the like mean including, but not limited to. Similarly, the singular form of "a" and "the" include plural references unless the context clearly dictates otherwise. And the term "number" shall mean one or an integer greater than one (i.e., a plurality).

What is claimed is:

1. A post-process apparatus, comprising:

a first operation portion that accepts a sheet conveyed from an image forming apparatus and performs a first operation based on a job involved with the sheet, wherein the first operation generates a first electric current;

a second operation portion, movable on a prescribed path, that accepts a sheet manually inserted into the post-process apparatus and performs a second operation different from the first operation, wherein the second operation generates a second electric current; and processing circuitry that determines timing to advance the sheet on the prescribed path and perform the second operation in relation to the first operation performed, such that a peak of the first electric current occurs at a different time than a peak of the second electric current.

2. The post-process apparatus according to claim 1, wherein the processing circuitry prioritizes the first operation over the second operation by changing the timing to perform the second operation.

3. The post-process apparatus according to claim 1, wherein:

the first operation portion performs the first operation on condition that the sheet conveyed from the image forming apparatus is sensed, the second operation portion performs the second operation on condition that the sheet is manually inserted into the post-process apparatus, and when the processing circuitry determines that the timing to perform the first operation at least partially coincides with the timing to perform the second operation, the processing circuitry changes the timing to perform the second operation based on a condition of conveyance of a sheet conveyed from the image forming apparatus to the post-process apparatus in succession to a sheet on which the first operation is to be performed.

4. The post-process apparatus according to claim 1, wherein:

the first operation portion performs the first operation on each of a plurality of sheets based on the job, and in changing the timing to perform the second operation, when the processing circuitry determines that the second operation cannot be performed before completion of the first operation onto the plurality of sheets, the processing circuitry controls the second operation portion to perform the second operation before completion of the first operation onto the plurality of sheets by increasing a distance between the sheets.

5. The post-process apparatus according to claim 1, wherein the processing circuitry prioritizes the second operation over the first operation by changing the timing to perform the first operation.

6. The post-process apparatus according to claim 1, wherein:

the second operation is an operation on the manually inserted sheet, the second operation portion is movable through a prescribed path based on a command from the processing circuitry and the second operation portion is temporarily held at a prescribed position on the prescribed path, when the second operation portion performs the second operation, and when the second operation is performed while the image forming apparatus and the post-process apparatus are not operating, the processing circuitry controls a holding power to hold the second operation portion at the prescribed position to be stronger than while the image forming apparatus and the postprocess apparatus are operating.

7. The post-process apparatus according to claim 1, wherein the first operation is a post-process on the sheet conveyed from the image forming apparatus.

8. The post-process apparatus according to claim 7, wherein the post-process is a punching operation to punch the sheet conveyed from the image forming apparatus, an auto-stapling operation to automatically staple the sheet conveyed from the image forming apparatus, or a center fold operation to fold the sheet conveyed from the image forming apparatus.

9. The post-process apparatus according to claim 1, wherein, when the first operation is an operation different from a post-process on the sheet and when the processing circuitry determines that the timing to perform the first operation at least partially coincides with the timing to perform the second operation, the processing circuitry changes the timing to perform the first operation.

10. The post-process apparatus according to claim 9, wherein, when the timing to perform the first operation is changed and when an error associated with the second operation occurs to result in failure in completion of the second operation, the processing circuitry controls the first operation portion to perform the first operation without waiting for completion of the second operation.

11. The post-process apparatus according to claim 9, further comprising:

an exit tray where the sheet conveyed from the image forming apparatus is ejected, wherein the first operation is an operation to move the exit tray upward and downward.

12. The post-process apparatus according to claim 1, wherein the second operation is a manual stapling process.

13. The post-process apparatus according to claim 1, wherein, when the processing circuitry determines that a total value of electric power for driving the first operation portion and electric power for driving the second operation portion exceeds a predetermined value, the processing circuitry determines operation timing of the first operation portion or operation timing of the second operation portion such that the total value is equal to or smaller than the predetermined value.

14. A post-process apparatus, comprising:

a sheet insertion portion;

a post-process portion that performs, at a prescribed post-process position, a first post-process on a sheet inserted from outside into the sheet insertion portion;

holding means for electrically holding the post-process portion at the prescribed post-process position; and processing circuitry that sets a holding electric power for electrically holding the holding means to a magnitude at which the post-process portion is not displaced from the post-process position in the first post-process by the post-process portion on the sheet inserted from the outside into the sheet insertion portion.

15. The post-process apparatus according to claim 14, wherein:

the post-process portion performs a second post-process on a sheet conveyed from an upstream apparatus, and the processing circuitry sets the holding electric power such that electrical holding power held by the holding means in the first post-process is larger in magnitude than electrical holding power held by the holding means in the second post-process by the post-process portion.

16. The post-process apparatus according to claim 14, wherein the processing circuitry sets the holding electric power such that electrical holding power held by the holding means in the first post-process is larger in magnitude than electrical holding power held by the holding means during stand-by of the post-process portion.

17. The post-process apparatus according to claim 14, wherein the processing circuitry sets the holding electric power to a magnitude at which the post-process portion is not displaced from the post-process position before a start of the first post-process.

18. The post-process apparatus according to claim 14, further comprising a detector that detects insertion of the sheet from the outside into the sheet insertion portion, wherein the processing circuitry sets the holding electric power to a magnitude at which the post-process portion is not displaced from the post-process position, as being triggered by detection of insertion of the sheet by the detector.

19. The post-process apparatus according to claim 14, wherein the processing circuitry lowers the holding electric power after completion of the first post-process.

20. A method of controlling a post-process apparatus, the method comprising:

accepting, by a first operation portion, a sheet conveyed from an image forming apparatus and performing, by the first operation portion, a designated first operation generating a first electric current;

accepting, by a second operation portion, a sheet manually inserted into the post-process apparatus and performing, by the second operation portion, a second operation different from the first operation, generating a second electric current; and determining timing to perform the second operation in relation to the first operation performed, such that a peak of the first electric current occurs at a different time than a peak of the second electric current.

* * * * *